US008757298B2

(12) United States Patent
Broussard, Jr.

(10) Patent No.: US 8,757,298 B2
(45) Date of Patent: Jun. 24, 2014

(54) METHOD AND APPARATUS FOR DUAL SPEED, DUAL TORQUE DRILLING

(76) Inventor: Edwin J. Broussard, Jr., New Iberia, LA (US)

( * ) Notice: Subject to any disclaimer, the term of this patent is extended or adjusted under 35 U.S.C. 154(b) by 306 days.

(21) Appl. No.: 13/066,828

(22) Filed: Apr. 26, 2011

(65) Prior Publication Data

US 2012/0273275 A1 Nov. 1, 2012

(51) Int. Cl.
*E21B 10/00* (2006.01)

(52) U.S. Cl.
USPC ..... 175/412; 175/398; 175/415

(58) Field of Classification Search
CPC ..... E21B 10/26; E21B 10/40; E21B 10/66; E21B 6/04; E21B 7/002; E21B 7/203
USPC ..... 175/415, 398, 412, 57, 424, 93, 107, 175/324, 385
See application file for complete search history.

(56) References Cited

U.S. PATENT DOCUMENTS

| | | | | |
|---|---|---|---|---|
| 7,562,725 | B1 * | 7/2009 | Broussard et al. | 175/93 |
| 2006/0027399 | A1 * | 2/2006 | Holte et al. | 175/57 |
| 2010/0181112 | A1 * | 7/2010 | Radford et al. | 175/57 |

* cited by examiner

*Primary Examiner* — Yong-Suk (Philip) Ro
(74) *Attorney, Agent, or Firm* — James L. Jackson

(57) ABSTRACT

A drilling unit for drilling a borehole and having an outer drill bit being rotationally driven by a primary rotary drive mechanism about a primary axis of rotation and having an outer bit cutting face disposed for drilling engagement with formation material. The outer drill bit defines an inner bit passage intersecting the outer bit cutting face. An inner drill bit is rotationally driven within the inner bit passage by a secondary rotary drive mechanism and has a secondary axis of rotation that can be the same or can be laterally offset from the primary axis of rotation. An inner bit cutting face is defined by the inner drill bit and is located within the inner bit passage. Rotation of the outer drill bit for borehole drilling causes orbital rotation of the inner drill bit about the primary axis of rotation simultaneously with rotation of the inner drill bit about the secondary axis of rotation for continuously cutting away formation material at the central region of the borehole being drilled.

22 Claims, 38 Drawing Sheets

METHOD AND APPARATUS FOR DUAL SPEED, DUAL TORQUE DRILLING

BACKGROUND OF THE INVENTION

1. Field of the Invention

The present invention relates generally to drill bit systems and mechanisms for drilling bores in a wide variety of materials such as earth materials for wells, rock materials for mining and various metal and polymer materials. More particularly, the present invention concerns the use of an outer drill bit that is rotated in any suitable manner and accomplishes drilling of a primary borehole. This invention also concerns an independently driven inner rotary drill bit, within the outer drill bit and which is arranged to simultaneously rotate and to move in orbital fashion to continuously and efficiently cut away the central region of the formation material that is not cut away by the outer drill bit. The present invention also concerns a drilling system that minimizes the weight or force that is applied during rotary drilling and permits efficient cutting of the formation material to achieve maximum drill bit penetration through the formation material.

2. Description of the Prior Art

While the present invention is discussed in this specification particularly from the standpoint of well drilling for the oil and gas industry, it is to be borne in mind that the spirit and scope of the present invention is applicable to the drilling of bores in other materials such as hard rock in the mining industry and for the drilling of bores in metal, wood, plastics and a wide variety of composite materials. Thus, the term "formation", within the scope of the present invention is intended to encompass most materials that are typically capable of being drilled or machined by rotary drilling apparatus.

Drilling of oil and gas wells employs a rotary system whereby a drill bit is rotated against formation material by a "drill string" to drill a wellbore. The drill string, which is composed of connected sections of tubular drill pipe, provides a method by which a fluid, typically called "drilling fluid" or "drilling mud" is pumped through the tubular drill string allowing the fluid to exit outlet openings of a drill bit at the location of formation cutting or removal. The pumped drilling fluid provides for cooling of the drill bit and serves to flush away the drill material (soil), also called "drill cuttings", from the drill bit location in the borehole and to convey the drill material to the surface. At the surface the drill material is separated from the drilling fluid and discarded, thereby permitting the cleaned drilling fluid to be again pumped through the drill string to the drill bit assembly. This process is generally known as drilling fluid "circulation".

Depending on the type of material to be drilled and the design of the bit, the size of the drill bit unit will differ. The earth formation materials to be drilled have different hardness and toughness. The drilling industry has developed many different types of drill bits to accommodate the drilling of boreholes of different depths and conditions. The drilling equipment may be provided in different sizes depending on the well depth and the subsurface formation conditions that are expected to be encountered. Drilling equipment may be "onshore", such as when land based drilling rigs are employed or may be "offshore", such as when well drilling is accomplished from floating drilling vessels or drilling systems that are operated from stationary offshore drilling platforms that are supported by the sea floor.

The speed or rate of penetration at which wellbores are drilled in earth formations determines, in part, the overall cost of the oil or gas wells. Therefore, the efficiency of the actual drilling operations determines the length of time that is required to drill the borehole and determines the time and expense of maintaining a well drilling rig at a well site. In general, the oil and gas industry has improved the "rate of penetration", i.e. drilling speed to a fairly efficient level over the years. Poly Diamond Crystalline "PDC" drill bits have contributed materially to the general improvement of borehole drilling. Typical PDC drill bits have some disadvantages, however, which are addressed in this specification, and which limit the rate of drill bit penetration in typical formation materials. In fact, the formation penetrating rate of most current drilling systems can be significantly improved by simple changes in drill bit design and function.

There is one area in which the oil and gas industry has failed to maximize the "rate of drill bit penetration" and that area is in hard rock drilling, which is typically encountered when wells of considerable depth are drilled or when drilling relatively hard formation material that is located at or near the surface. These areas of hard rock drilling are encountered at various depths both onshore and offshore. In the case of offshore locations, the rental or amortization costs of surface drilling equipment can be 20,000 to 500,000 US Dollars per day. It is possible that the depth of the wells can exceed depths of 30,000 feet. Therefore, large areas of hard rock drilling are typically encountered in order to reach the depth of a production formation containing paying reserves of petroleum products. In hard rock materials the drilling "rate of penetration" can be as low as one foot per hour when conventional PDC drill bits are employed. Therefore, the cost of wells can be as much as 20,000 US Dollars per foot of drilling, thus being potentially detrimental to the desired return of investment. Clearly there has been a need for a considerable period of time to provide a system for well drilling in a hard rock environment that provides for significant improvements in the rate of drill bit penetration, so that wells can be drilled and completed for production at costs that are not prohibitive.

As can be understood, any improvement in the drilling speed will significantly reduce the cost of well drilling and completion. The drilling of hard rock is being conducted at the present time through the use of "PDC" Poly Diamond Crystalline bits. The PDC bit is presently the best method to drill hard rock using PDC bits and associated systems. PDC bits employ a machining method or formation cutting action in the removal of relatively hard formation materials. As in metallic machinery or milling, a specific depth of cut is determined, (i.e. depth of cut). Similar to the metal cutting action in metallic machining, the bore material is removed by the cutting elements of the drill bit as the bit is rotated against the formation material. The number of revolutions of a drill bit per unit time and the depth of cut causes the mill to machine the bore material at a desired rate of penetration.

Drilling of oil and gas formations employs a system to remove the formation material by machinery. Therefore, the speed of rotation and "depth of cut" determines the "rate of drill bit penetration" into the formation. The above stated method is considered to be the "state of the art" at the present time. However, during drill bit rotation the cutting elements of conventional PDC drill bits achieve efficient cutting of formation material near the outer periphery of a drill bit because cutter speed relative to the formation material is optimum at the outer peripheral region of the bit. This formation cutting efficiency degrades in relation to the distance of the PDC cutting elements from the axis of rotation of the drill bit. At the inner region of a conventional PDC bit the cutter elements have much slower cutting speed relative to the formation material, which causes the efficiency of the formation cutting activity of the innermost cutting elements to be diminished. Due to the inefficient cutting capability of the cutting elements near the central portion of a drill bit the central region of the wellbore being drilled is not cut away efficiently and serves to resist forward movement of the drill bit through the formation even though the cutter elements of the outer portion of the drill bit cutting face have the capability for efficient formation cutting activity. The inefficiently cut central region of the wellbore functions as a drilling resistance region by propping up or resisting forward movement of the entire drill bit, thus retarding the rate of penetration that could otherwise be achieved. Thus, the inefficiently cut central region of a the formation being drilled to form a borehole is referred to as a "resistance region".

During wellbore drilling as hard formation material is encountered roller cone type drill bits are typically employed for the drilling process. The roller cones of these bits have teeth that are typically faced with a hard wear resistant material such as tungsten carbide. The roller cones may also have tungsten carbide inserts when very hard formation material is encountered. As the roller cones rotate the teeth of the cones essentially chisel, chip or flake away the formation material rather than cutting it away. As certain types of hard formation material is encountered, PDC drill bits are employed and have multiple diamond cutting elements that are positioned cut away the formation material as the drill bit is rotated. As even harder formation material is encountered drill bits are employed having cutting faces that are formed of a metal substrate in which diamond cutting elements are embedded. As drilling progresses the metal substrate material will be worn away by the abrasive action of the formation material, exposing other embedded diamond cutting elements. These embedded diamond type drill bits are typically driven at higher rotary speed than other drill bits.

Regardless of the type of drill bit that is employed for drilling in hard formations the cutting elements at the outer portions of the cutting face are rotated at a speed for efficient drilling, but the innermost cutting elements, due to their much slower cutting speed, accomplish very little cutting of the formation material. Thus, as the drill bits are rotated against the formation material an inefficiently cut region of the formation at the center region of the wellbore remains and resists drill bit penetration. To enhance the efficiency of well drilling the operator of the drilling rig will typically apply relatively high drill stem weight to the drill bit so that the resistance region of the formation material being drilled is crushed by the weight of the drill string and drill bit rather than being cut away. A drill bit weight in the range of about 20,000 pounds, for example, is the typical weight for efficient cutting of the formation material by the cutting elements at the outer portion of the drill bit. Because of the efficiency retarding effect at the central resistance region of the wellbore, the driller may need to apply a drill bit weight in the range of 70,000 pounds, for example, to accomplish continual crushing of the resistance region of the formation that results due to the degradation of cutting efficiency that results from the relatively slow movement of the central cutting elements against the formation. It is desirable therefore to provide a method of formation drilling which accomplishes efficient cutting of the formation material at both the central and outer regions of a wellbore, thus eliminating the need for application of formation crushing drill bit weight and permitting the cutting elements at both the outer region and the central region of the drill bit to accomplish efficient cutting of the formation material, thus resulting in efficient drill bit penetration.

Drilling systems for deep wells typically employ a drill collar in the drill string above the drill bit. The drill collar is typically composed of stiff tubular material such as steel that resists flexing as drilling weight is applied via the drill string. The drill collar may have a length in the range of 1000 feet for deep well drilling. When a sufficiently high drill string weight is applied for crushing the formation material at the central region of the wellbore, as indicated above, even a stiff drill collar will be flexed to the point of having a portion of it establish contact with the wellbore wall. When this condition occurs the cutting face of the drill bit will be oriented at a slight angle with respect to the centerline of the drill collar, thus causing the wellbore being drilled to deviate slightly from the intended centerline of the intended wellbore. It is desirable, therefore, to provide a method for well drilling that permits the use of a sufficiently low drill bit weight that the drill collar resists any tendency for flexing and permits efficient straight ahead drilling.

The invention which is described in this specification and illustrated in the appended drawings teaches a different and improved approach to the drilling of oil and gas boreholes, whereby the "rate of penetration" of a drilling unit is significantly enhanced and the cost of well drilling is minimized.

SUMMARY OF THE INVENTION

It is a principal feature of the present invention to provide a novel well drilling system for hard formation drilling which employs a drilling unit having an outer drill bit that is rotated by a primary power source and within an passage of the outer drill bit an inner drill bit is rotated by a secondary power source and has both rotation and orbital movement relative to the outer drill bit for continuously cutting away formation material at the central region of the wellbore being drilled while the outer drill bit efficiently cuts away the major portion of the formation material that is removed to define the wellbore.

It is another feature of the present invention to provide a novel well drilling system having an outer drill bit driven by the rotary drill string and an inner orbital drill bit within the outer drill bit which is driven by the hydraulic system of a drilling rig, such as the hydraulic pumps that pump drilling fluid through the drill string from the surface and which achieves rapid drill penetration by intregating the full horsepower of the rotary drill stem at the drill bit assembly for driving the outer drill bit and the full horsepower of the hydraulic system of the drilling rig at the inner drill bit.

It is another feature of the present invention to provide a novel well drilling system for hard formation drilling which employs an outer drill bit having cutter elements and is rotated at a desired speed for efficient penetration into the formation material and an inner drill bit which can be rotated at a greater speed that the outer drill bit and is moved orbitally by the outer drill bit for continuously and efficiently cutting away the formation material of the central region of the borehole being drilled.

It is another feature of the present invention to provide a novel borehole drilling system for hard formation drilling wherein an outer drill bit, driven by a primary power source, defines a primary axis of rotation and defines an inner drill bit passage intersecting the cutting face of the outer drill bit and having an inner drill bit within the inner drill bit passage that is driven by a secondary power source and defines a secondary axis of rotation being laterally offset from the primary axis of rotation and being of sufficient circular dimension that an outer portion of the inner drill bit passes across the primary axis of rotation and cuts away formation material at the central region of the borehole being drilled.

It is also a feature of the present invention to provide a novel borehole drilling system for hard formation drilling wherein an inner drill bit within an inner bit passage of an outer drill bit can be designed to rotate at a faster rotary speed as compared with the rotary speed of the outer drill bit and may be rotated in the same rotary direction or in the opposite rotary direction as compared with the direction of rotation of the outer drill bit.

Briefly, the various objects and features of the present invention are realized through the provision of an outer PDC drill bit having a cutting face to which is fixed a multiplicity of PDC cutter elements that are oriented for cutting away hard rock formation material to drill a borehole. Within the outer drill bit is defined an inner bit passage having an inner PDC drill bit that is rotatably driven by a separate power source such as a fluid energized turbine or mud motor. The rotation speed of the inner drill bit is variable and is typically significantly faster than the rotary speed of the outer drill bit. The inner drill bit is typically driven by a shaft that is rotated by the rotor of a mud motor by drilling fluid that is pumped through the space between the rotor and the rubber stator of the motor. The drilling fluid powering the turbine or mud motor is then discharged into the borehole from drilling fluid outlet passages of the inner drill bit for the purpose of cooling and for drill cutting removal. The drilling fluid can also be discharged into the borehole from drilling fluid outlet passages of the outer drill bit if desired.

The inner bit passage is located eccentric with respect to the axis of rotation of the outer drill bit thus causing the inner drill bit to have orbital motion within the wellbore as it is driven rotationally by a secondary power source. This orbital motion can be caused by an offset relation of the outer drill bit with respect to its drill collar or drill stem or can result from offset location of the cutting face of the inner drill bit relative to the outer drill bit or by an angular relation of the axis or rotation of the inner drill bit relative to the axis of rotation of the outer drill bit. As the outer drill bit rotates against the formation its cutter elements cut away the major portion of the formation material at the outer region of the wellbore being drilled. The orbital rotational movement of the inner drill bit, together with its high speed rotational movement, clockwise or counter-clockwise, causes efficient cutting of the inner region of the formation material, thus eliminating the formation material that typically forms the resisting region that is described above. With the inner resisting region of the formation material continuously and efficiently removed by the cutting elements of the inner drill bit, the PDC cutting element from the central region toward the outer region of the cutting face of the outer drill bit will have exceptional formation cutting efficiency across its entirety. The drilling system of this invention is capable of achieving rapid penetration into the formation due to the efficiency of its formation cutting activity across its entire cutting face. Efficient drilling penetration of the drill bit is also enhanced by providing the full horsepower of the rotary drive mechanism of the drilling rig for rotation of the outer drill bit and also providing the full horsepower of the hydraulic system of the drilling rig for rotation of the inner drill bit. Thus the drilling system essentially provides double or multiple horsepower at the drill bit assembly for enhancing drill bit penetration.

Thus, the present invention relates generally to drill bit systems and mechanisms for drilling bores in a wide variety of materials such as earth materials for wells, rock materials for mining and various metal and polymer materials. More particularly, the present invention concerns the use of an outer drill bit that is rotated in any suitable manner and accomplishes drilling of a primary borehole. Within the outer bit is recessed an inner drill bit that is capable of rotating at a different, typically faster speed as compared with the rotary speed of the outer drill bit. This invention also concerns location of the inner drill bit in eccentric relation with respect to the axis of the outer drill bit so that during rotation of the primary drill bit the drilling face of the inner orbital bit is caused to pass across the central formation region of the primary wellbore and continuously cuts away the central penetration resisting region of the formation that typically results from the drilling inefficiency that typically results from rotation of a conventional PDC drill bit.

Typically, wells are drilled for oil and gas production by rotating a drill stem in the clockwise direction. The inner drill bit may also be rotated in the clockwise direction, typically at a greater rotational speed as compared with the rotation speed of the outer drill bit. In the alternative, however, the inner drill bit may be driven in a rotational direction that is opposite the rotational direction of the outer drill bit. For example, the outer drill bit may be rotated in a clockwise direction and the inner drill bit may be driven in a counter-clockwise rotational direction. If a drilling system is designed to rotate an outer drill bit in a counter-clockwise rotational direction, then the inner drill bit could be rotated clockwise. However, virtually all well drilling systems are designed for clockwise rotation of a drill bit, so the counter rotational direction for the inner drill bit is counter-clockwise as viewed from a drilling rig floor.

Theory of Invention

At the present time "state of the art" PDC drilling methods are being employed in all areas of the world, via land based drilling systems and subsea drilling systems. The invention described herein employs a specific downhole assembly, employing PDC cutters. The basic theory of this invention is to provide a method in which a center, centerless borehole is formed. The center hole provides a method in which the center area is removed by a separate drilling operation, which is efficient and removes only a small percentage of the total borehole to be formed. The center hole removes approximately 4%-25% of the required final borehole volume.

The center, centerless borehole is generated by a special bit which can operate at a high rotational speed. The high rotational speed can set the maximum "rate of penetration" of the drilling operation. The high speed quality of the center, centerless hole bit is supported by the pattern in which the center, centerless bit is simultaneously rotated about its longitudinal axis and also is rotated orbitally about the longitudinal axis of the primary or outer drill bit. The orbit motion of the inner or secondary drill bit is provided to cause the center portion of the borehole being drilled to be void of an actual center point. The orbit path of the center, centerless drill bit system is provided by an off-center outer or reamer drill bit assembly which has dimensions equal to the internal dimension of the desired final borehole. The reamer assembly removes the remaining and the majority volume of material to form the finished borehole. This invention incorporates separate power sources which supports the center, centerless bit and reamer assembly.

The present invention is described as per the following statement:

"The downhole drilling system employs a dual speed, dual torque power system. The drilling system employs a method which drills a center, centerless hole using a high rotating speed. The center, centerless drill bit path travels in an orbital orbiting pattern due to the rotary motion of the drill stem and is simultaneously rotated in a selective direction by the hydraulic system of the drilling rig. The reamer unit which guides the final borehole is offset, which causes the orbiting pattern of the center, centerless drill bit."

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is a schematic illustration of a well drilling system incorporating the principles of the present invention;

FIG. 2 is a sectional view of a dual speed, dual torque drilling system according to the present invention and which simultaneously employs the speed and torque of a rotary drive system for a primary drill bit and the speed and torque of a hydraulic drive system for a secondary drill bit;

FIG. 3 is a longitudinal sectional view of the lower portion the drilling system of FIG. 1 and showing the components thereof in greater detail;

FIG. 4 is a bottom view of the drilling system of FIGS. 2 and 3 and in broken line showing the secondary or inner drill bit of the drilling system;

FIG. 5 is a bottom view similar to that of FIG. 4 and having a portion thereof shown in section and further showing the relation of the secondary or inner drill bit in relation to the primary or outer drill bit;

FIG. 6 is a schematic illustration showing primary and secondary drill bits according to the present invention and further illustrating the rotational relationships thereof;

FIG. 7 is also a schematic illustration showing the lateral offset relation of the axes of rotation of the primary and secondary drill bits and the orbital relationship of the secondary drill bit to the primary drill bit during rotation of the primary drill bit;

Figure 8:
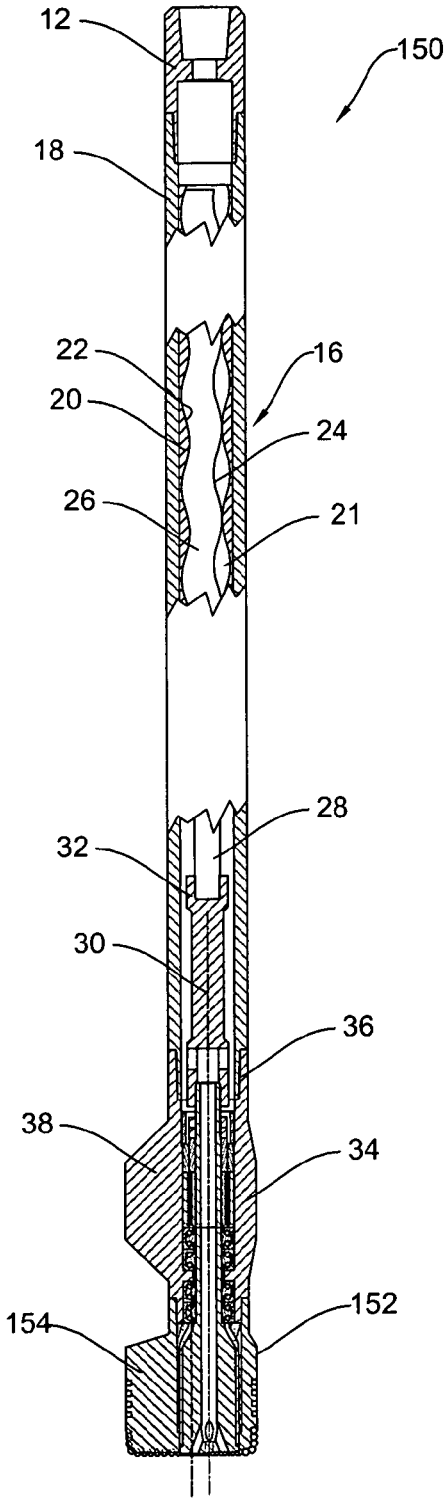
Figure 9:
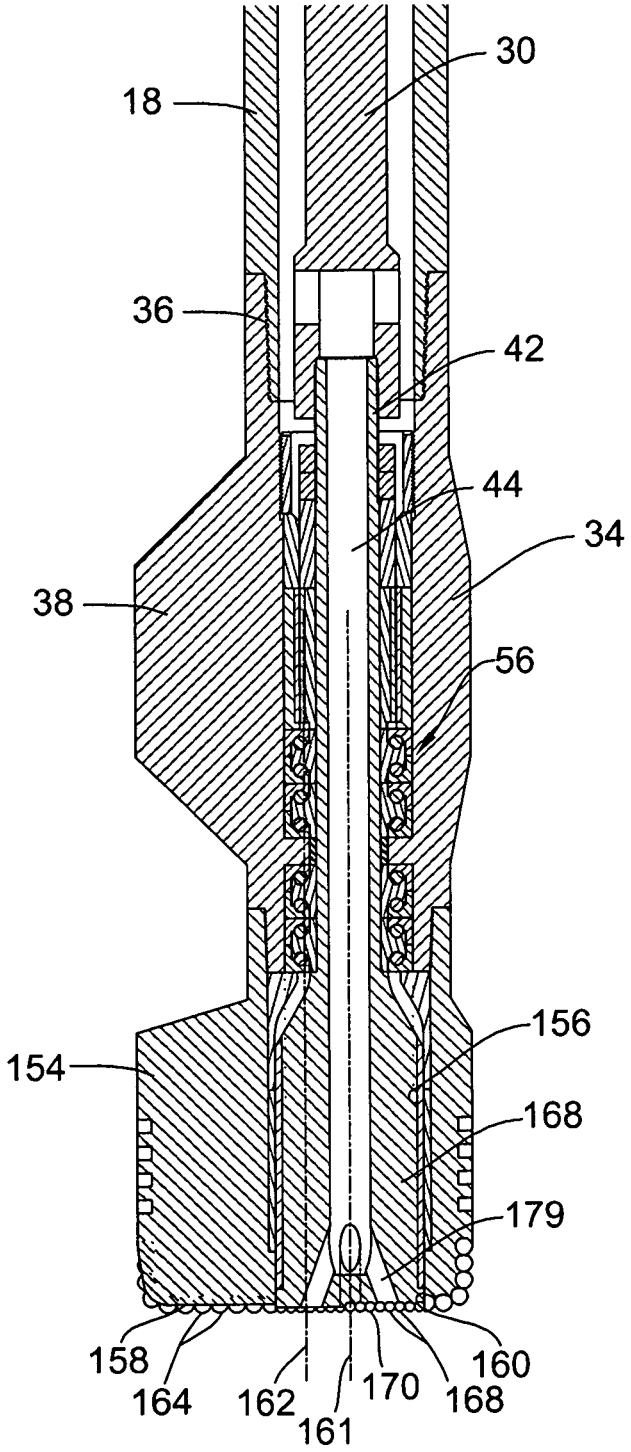
Figure 10:
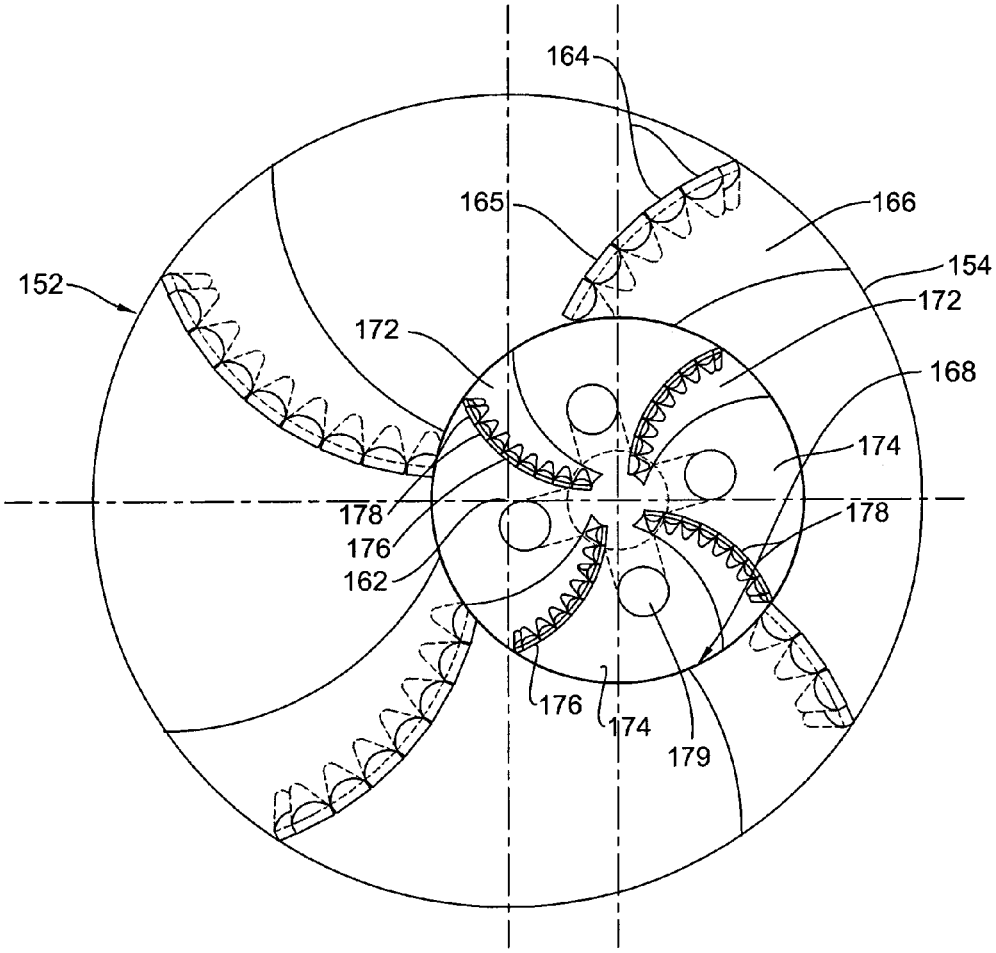
Figure 11:
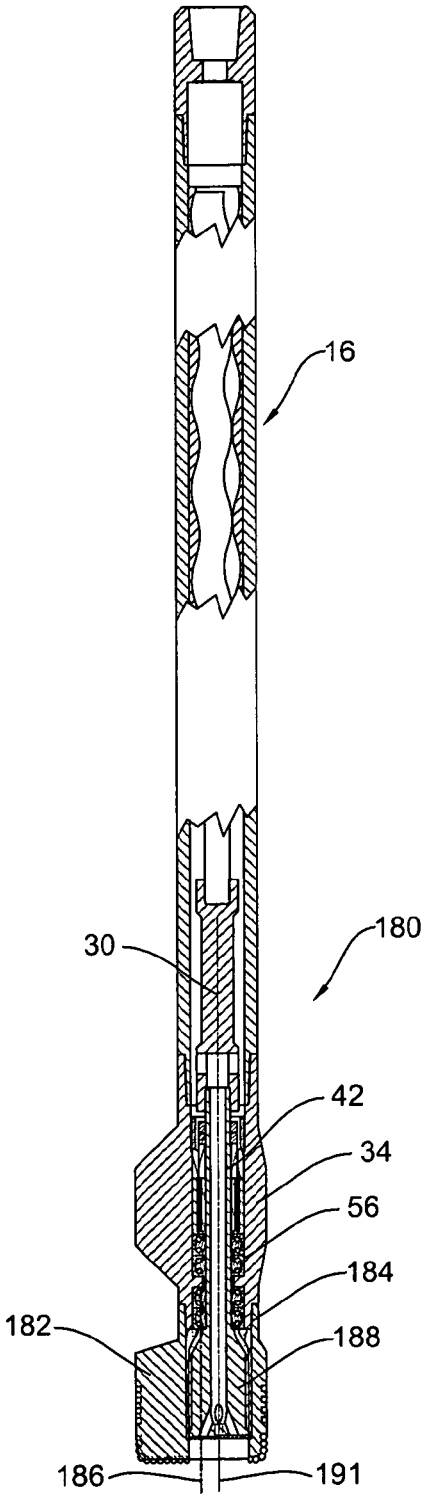
Figure 12:
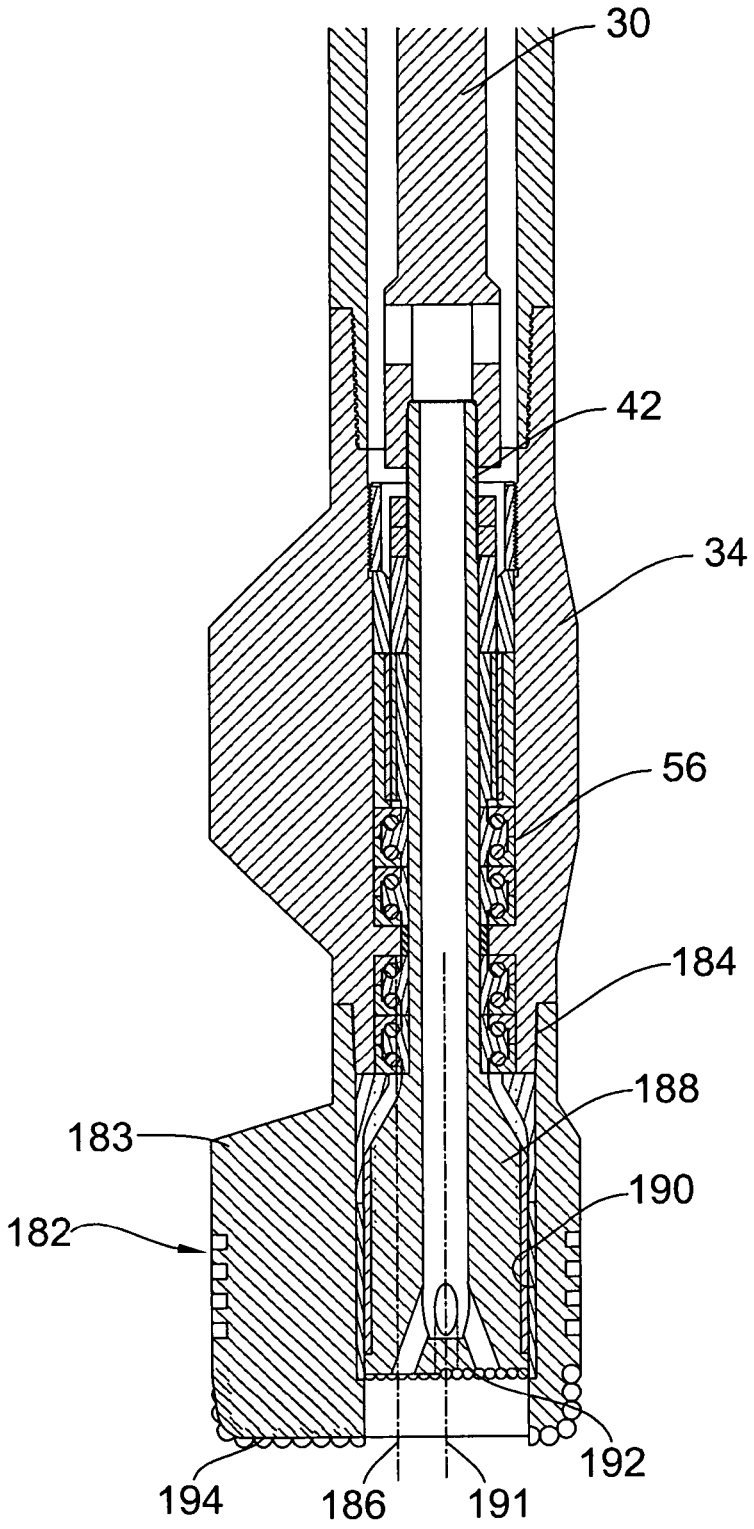
Figure 13:
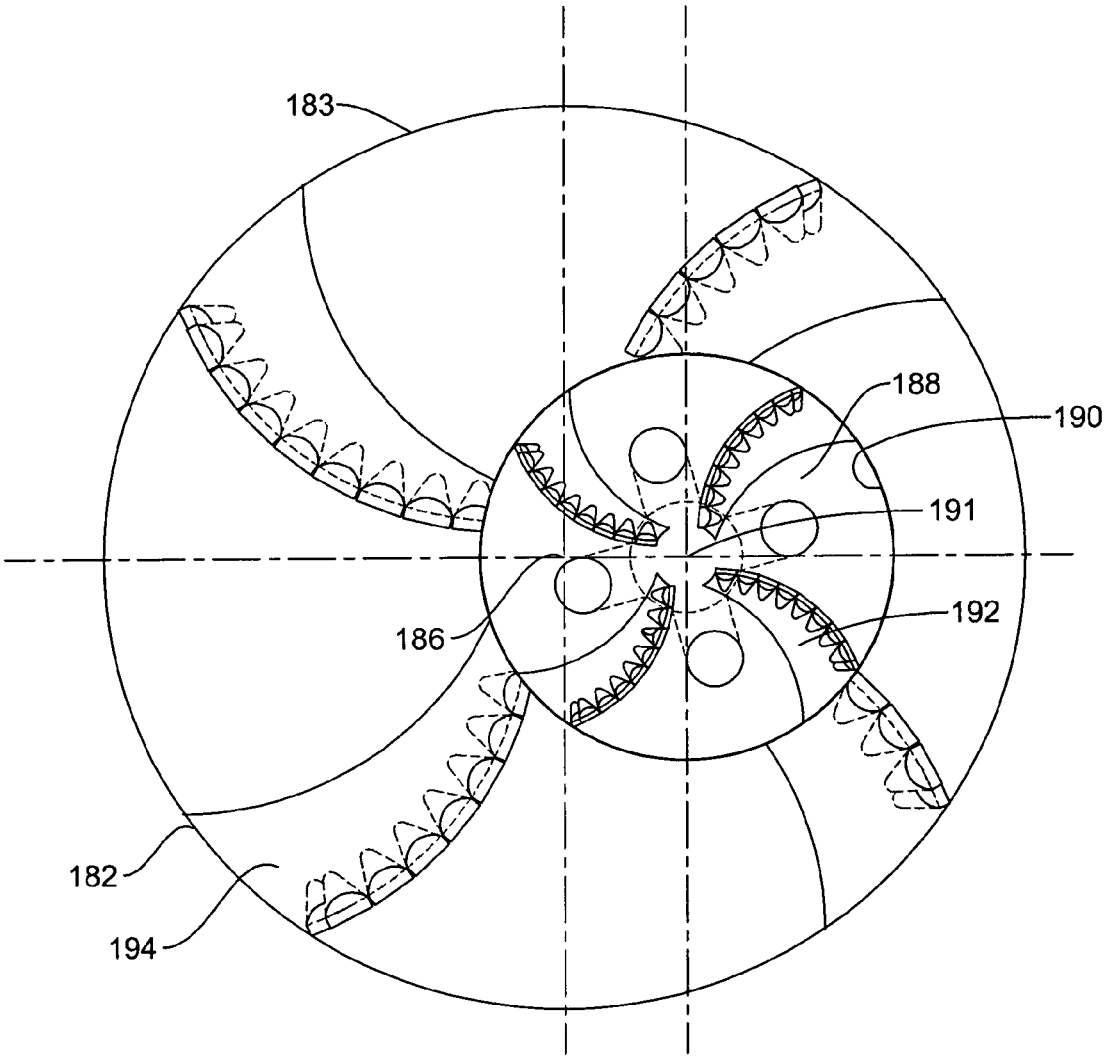
Figure 14:
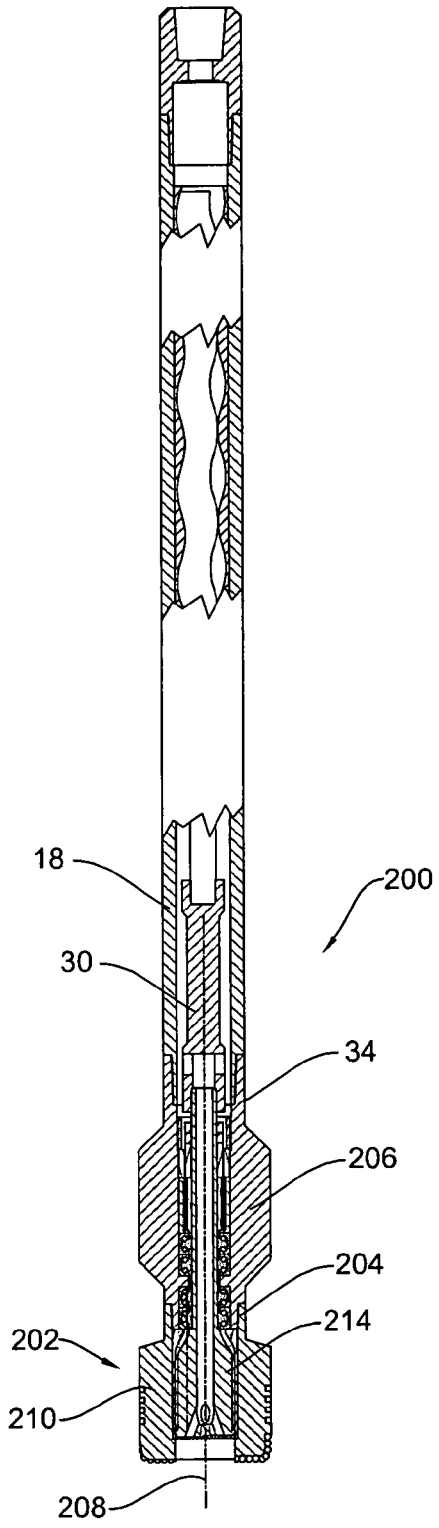
Figure 15:
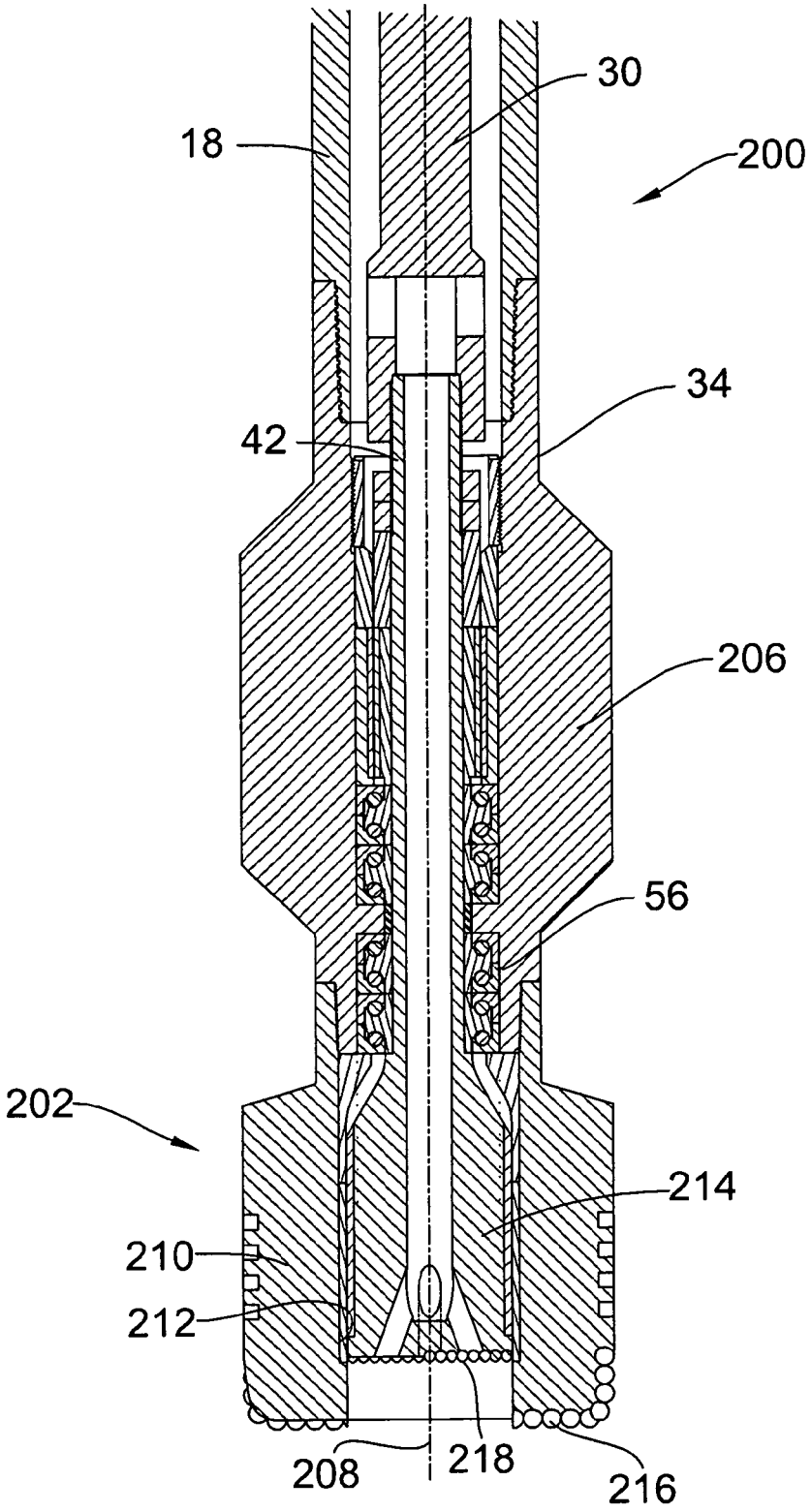
Figure 16:
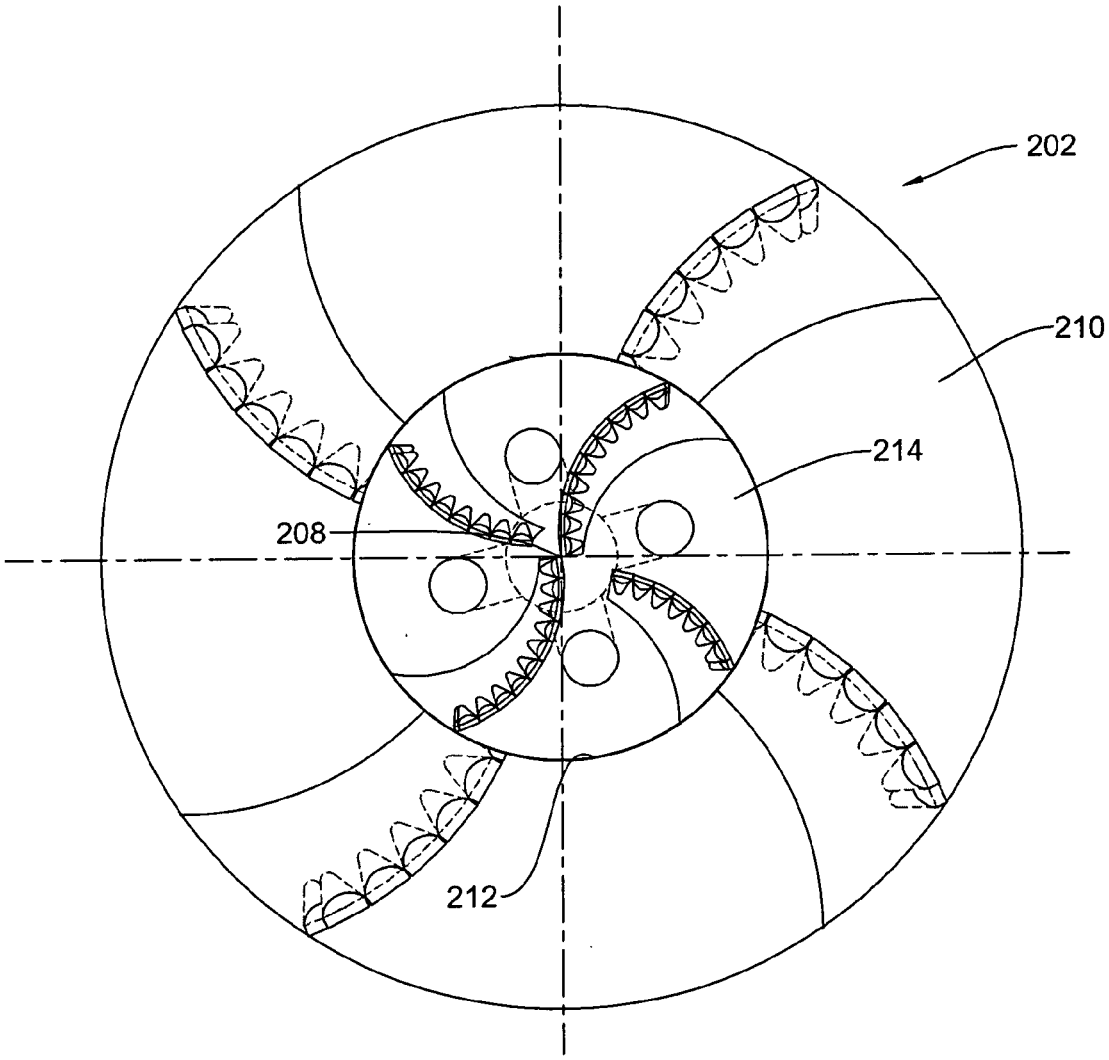
Figure 17:
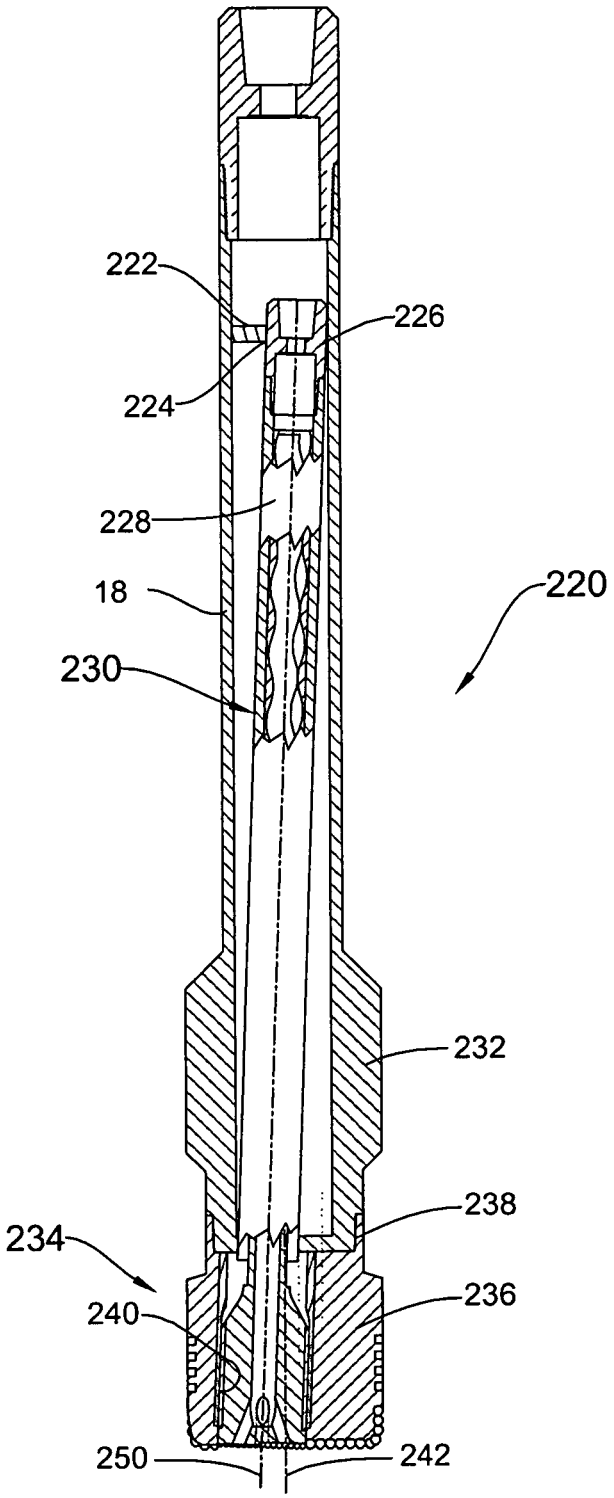
Figure 18:
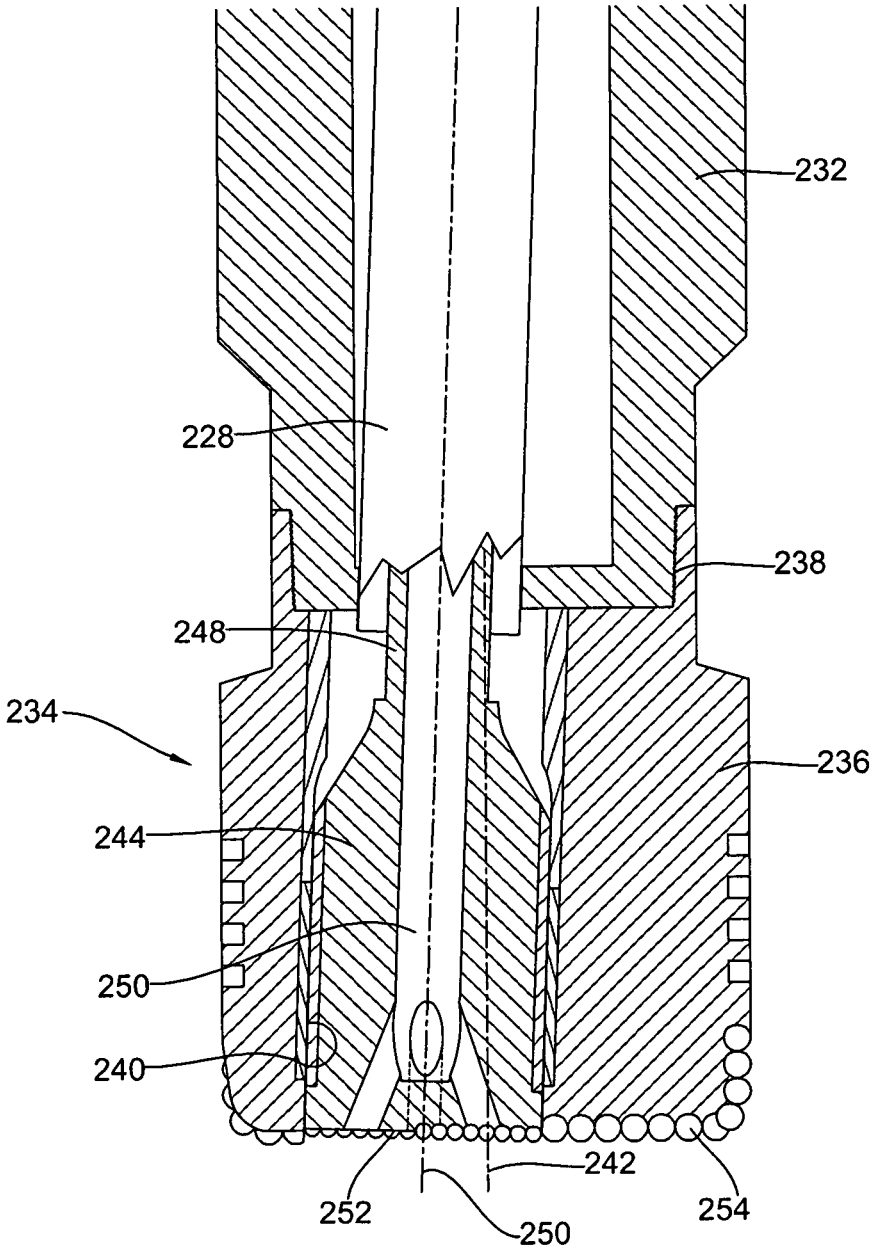
Figure 19:
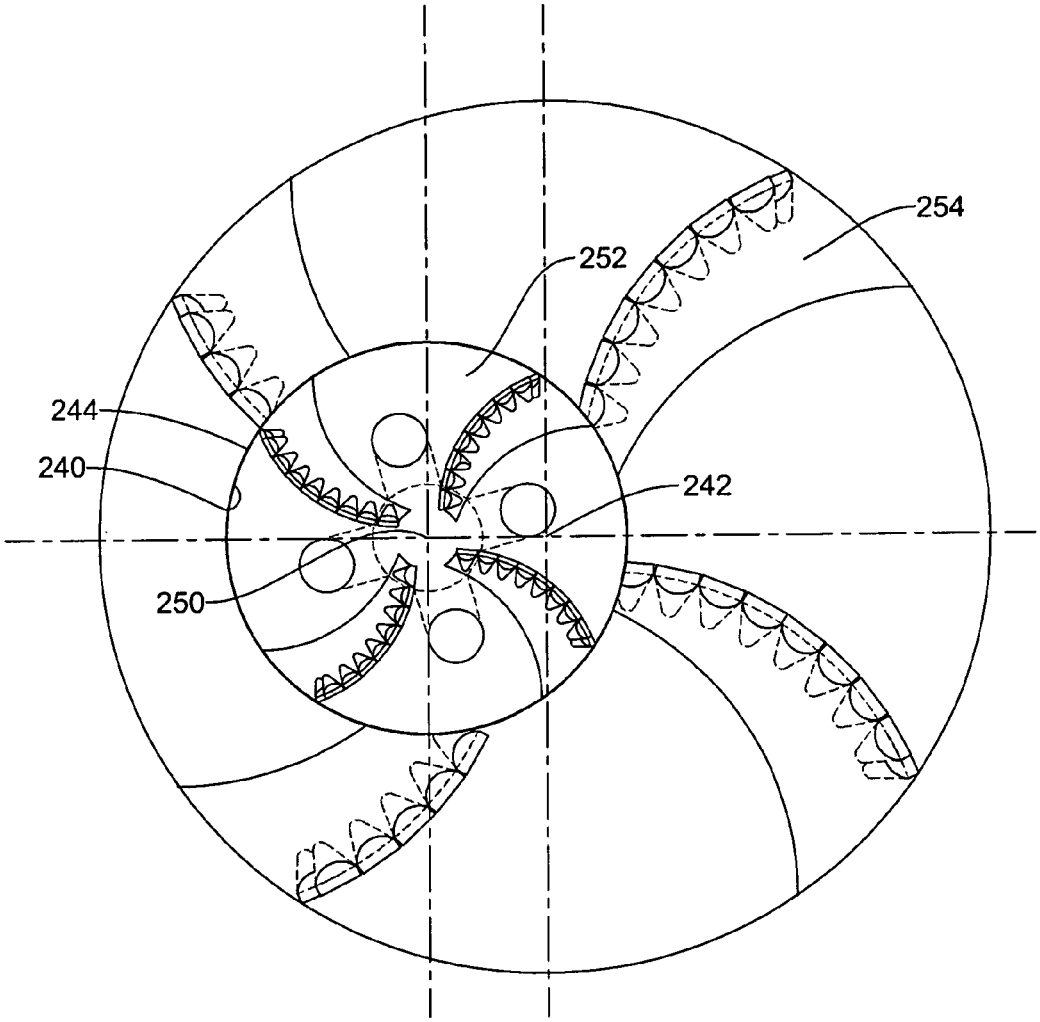
Figure 20:
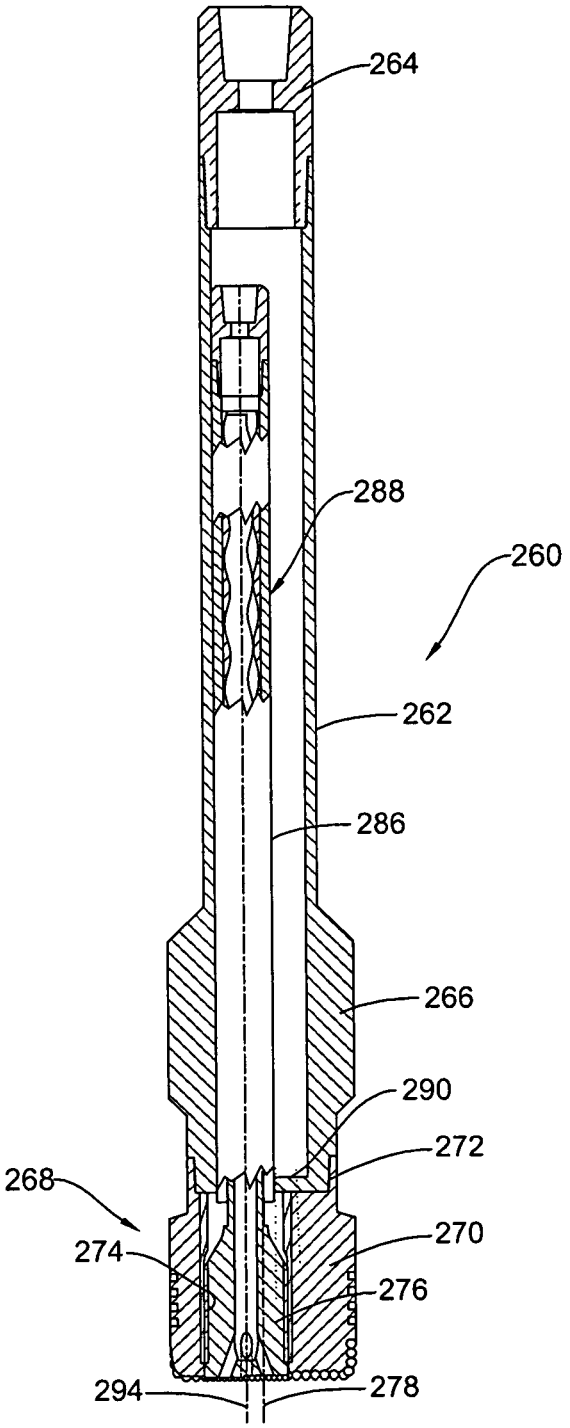
Figure 21:
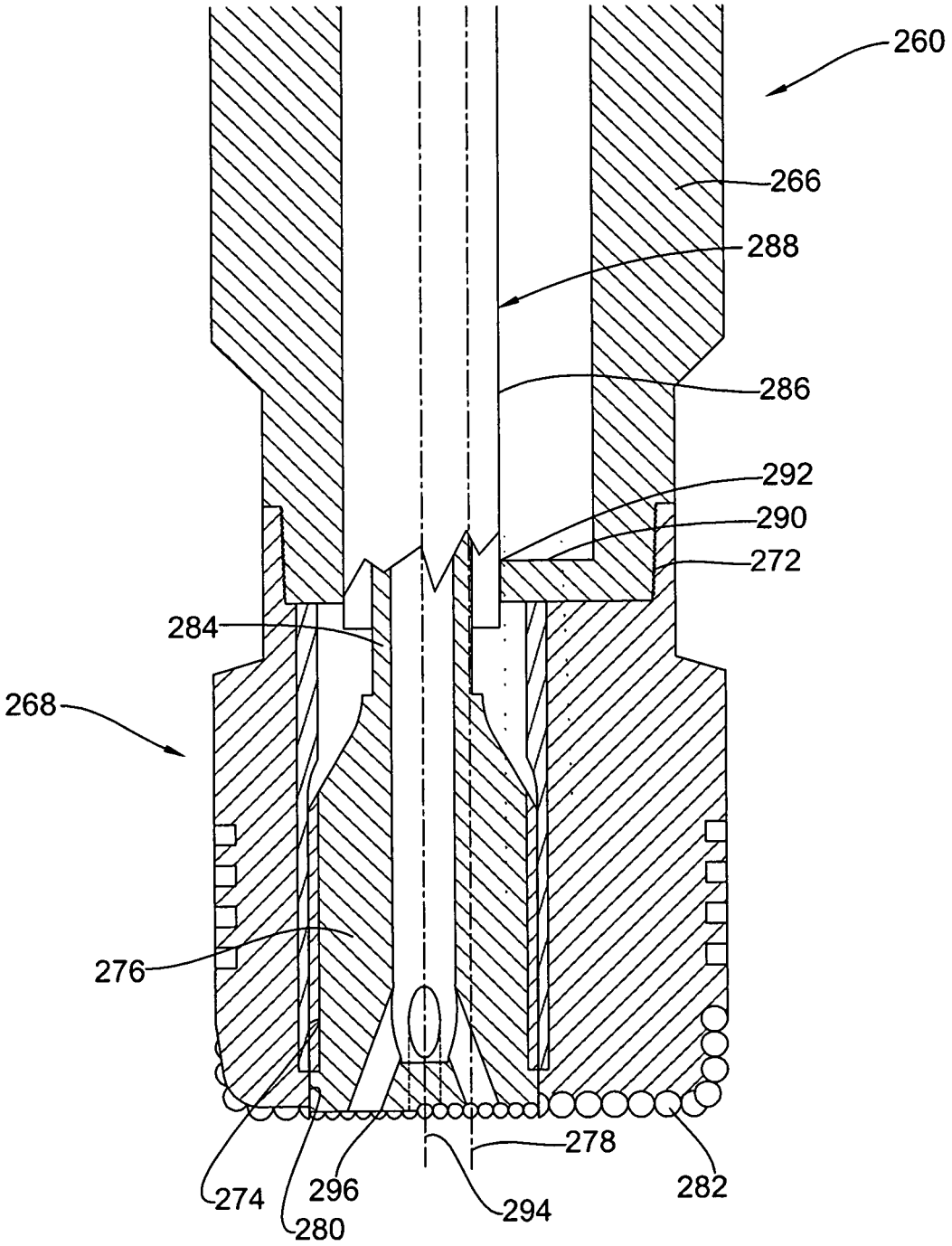
Figure 22:
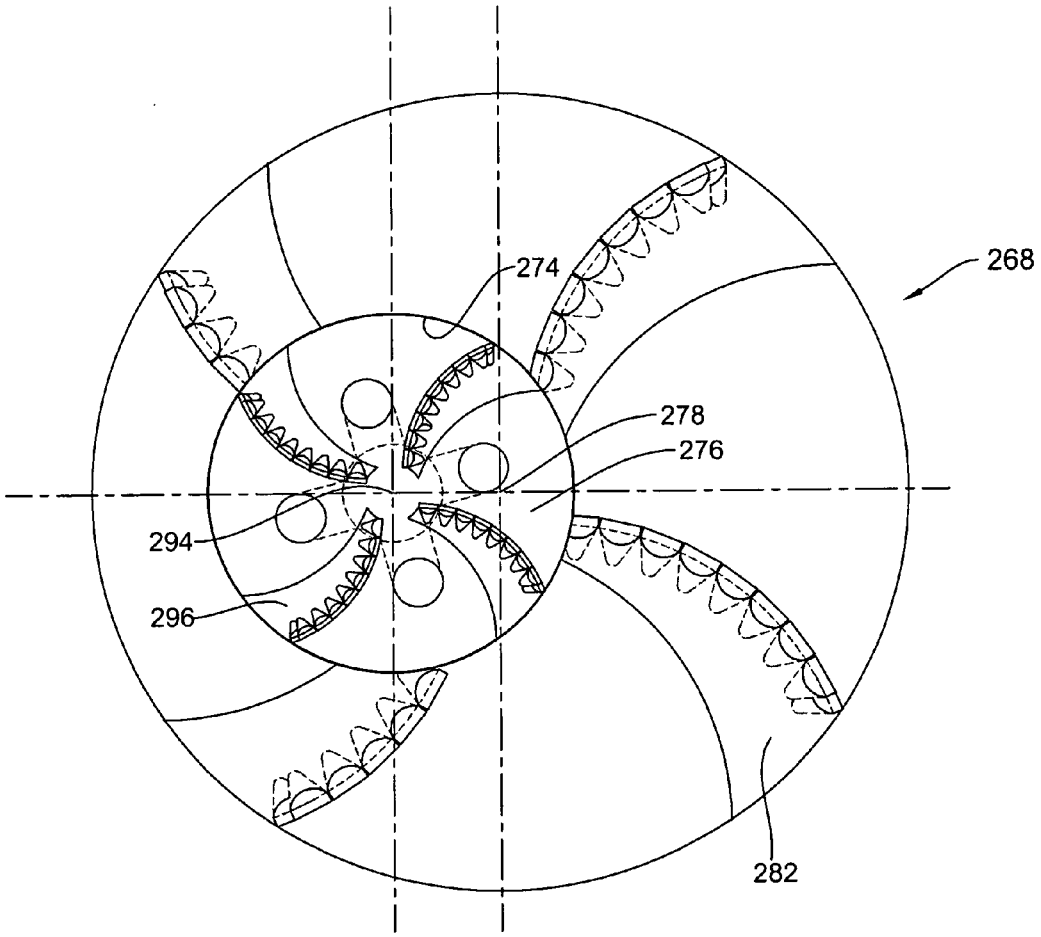
Figure 23:
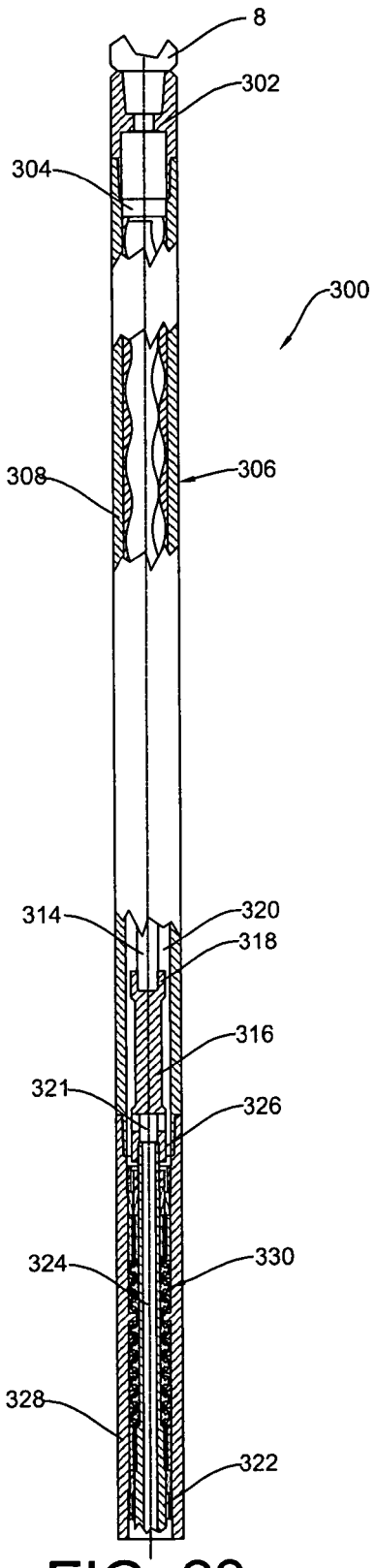
Figure 24:
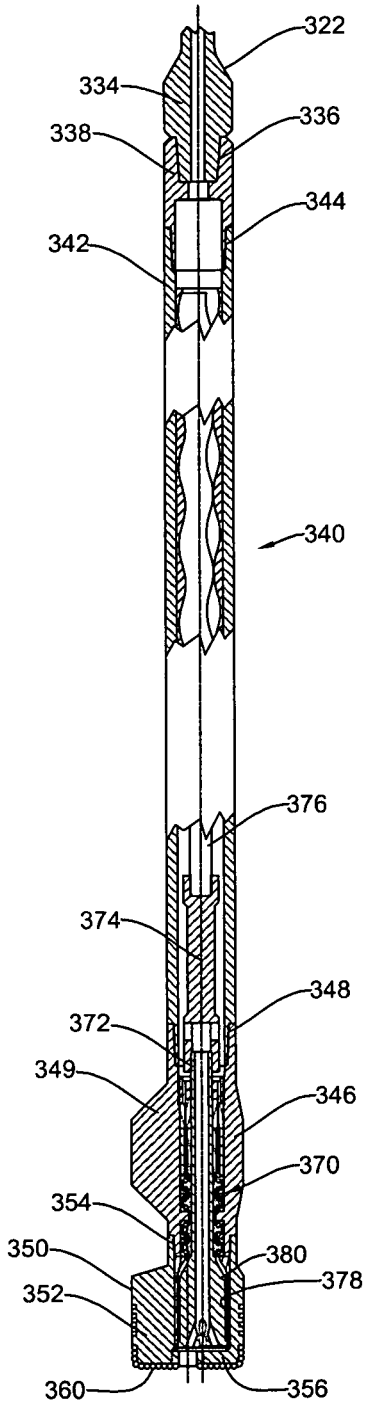
Figure 25:
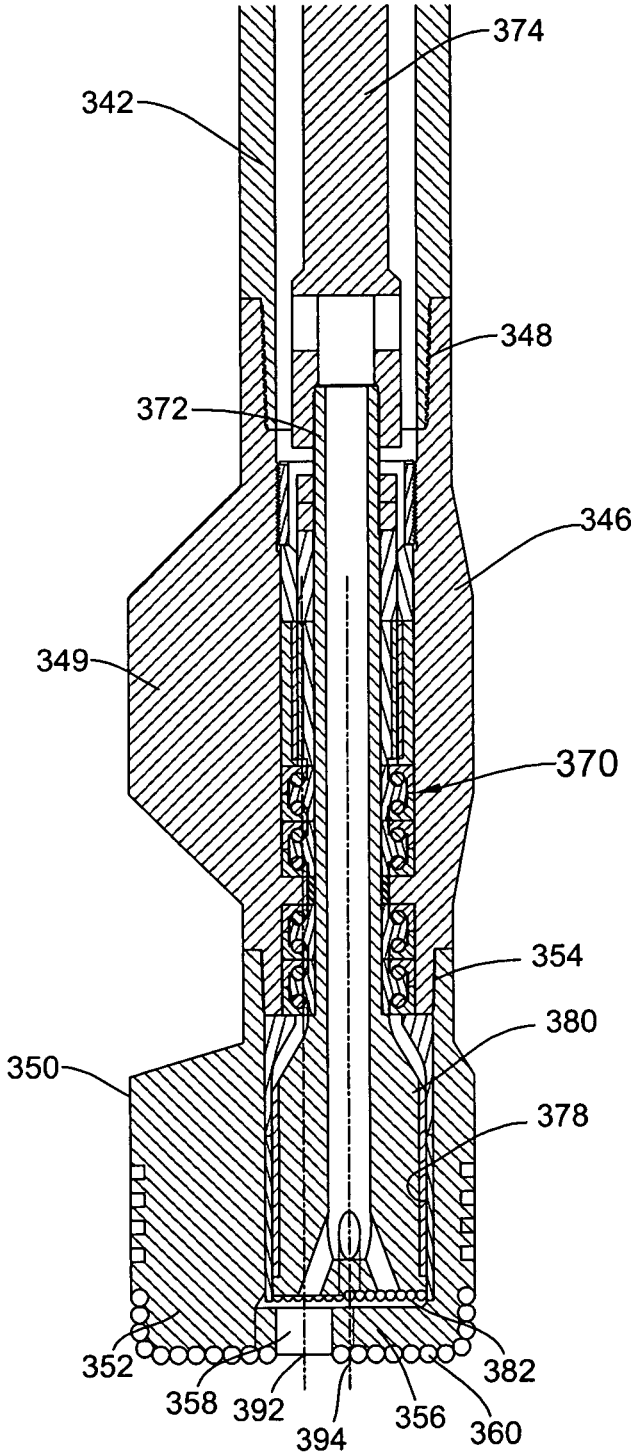
Figure 26:
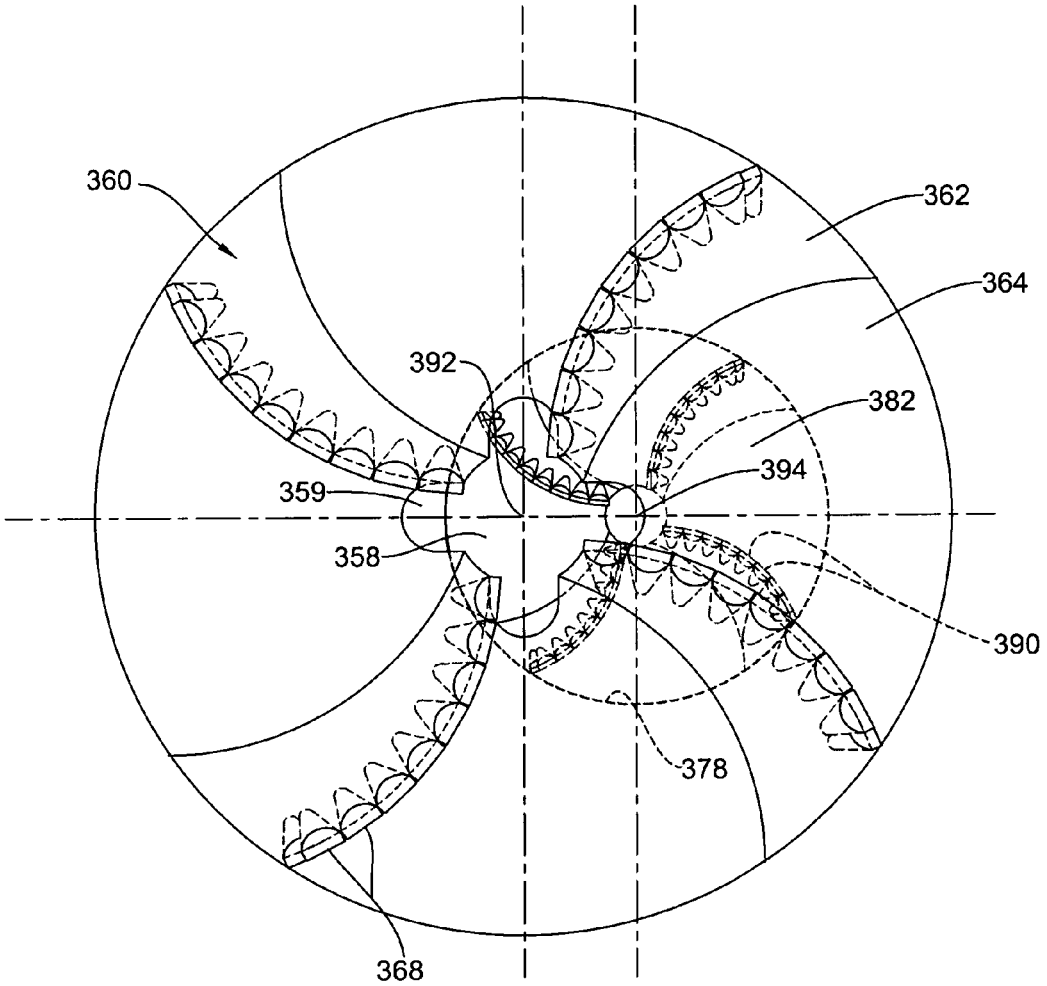
Figure 27:
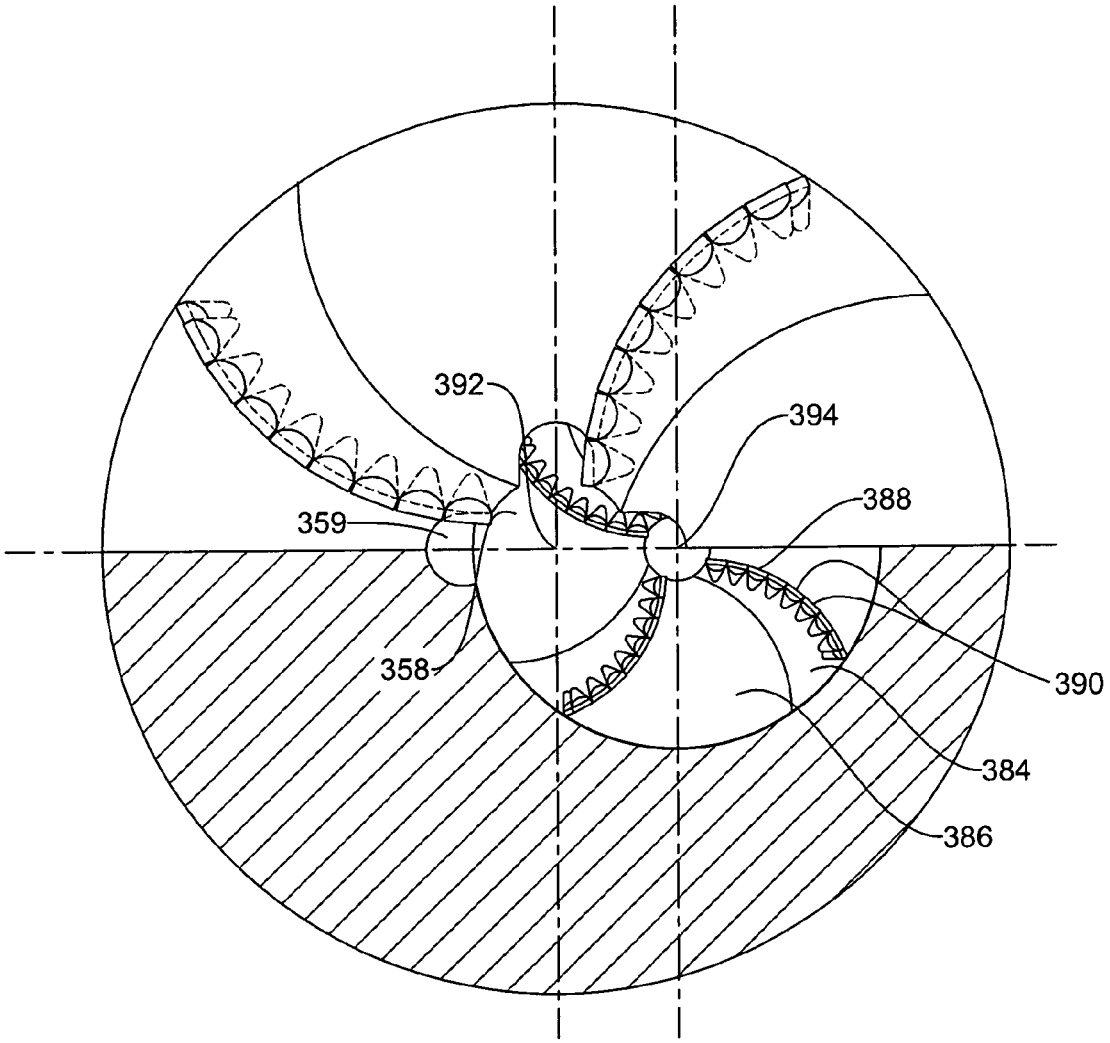
Figure 28:
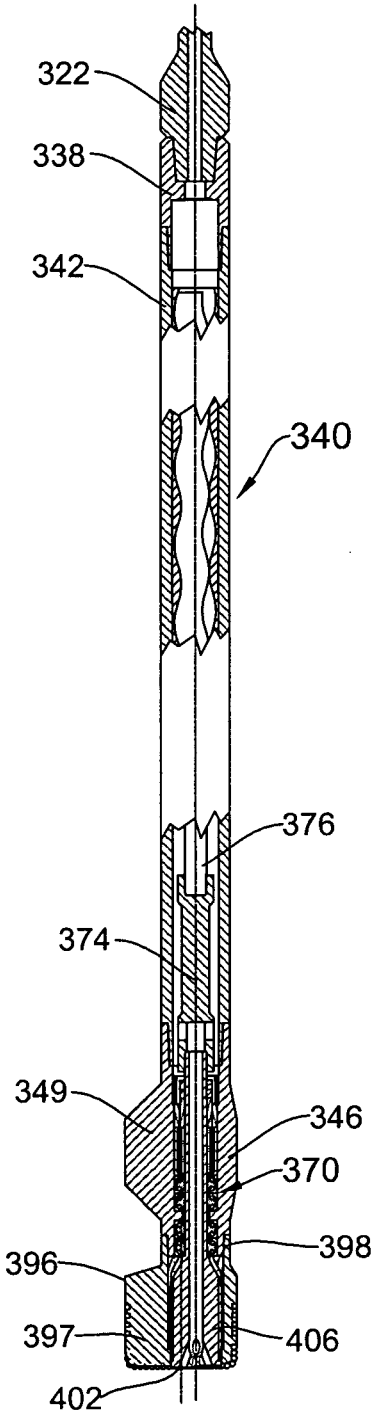
Figure 29:
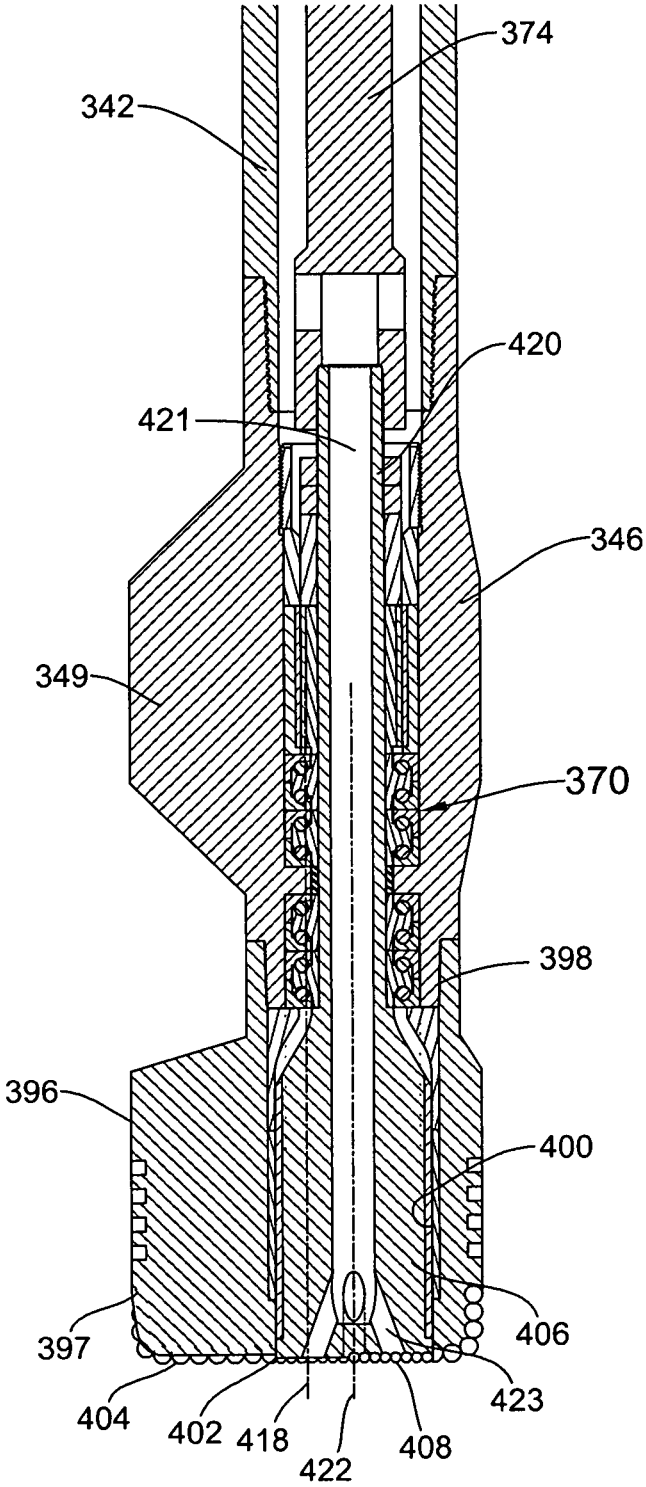
Figure 30:
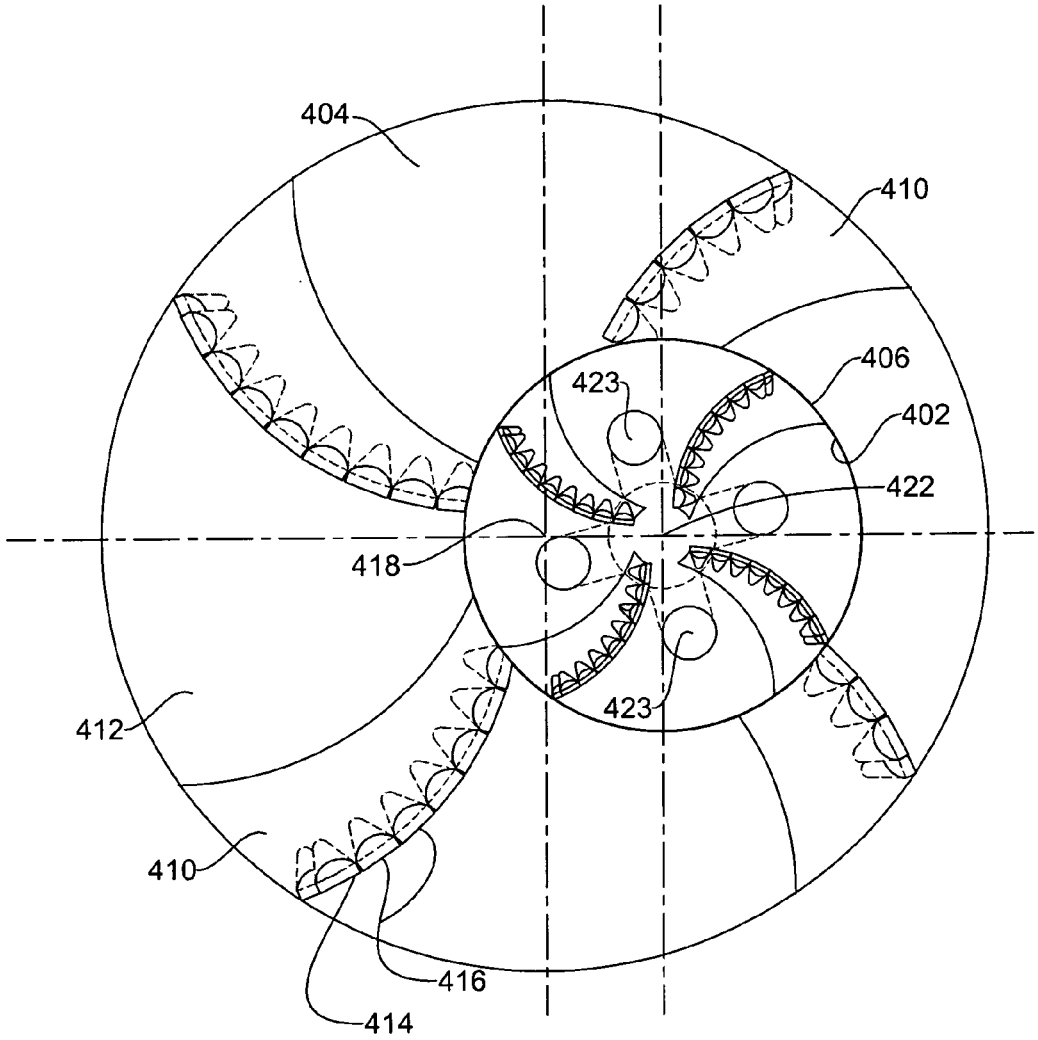
Figure 31:
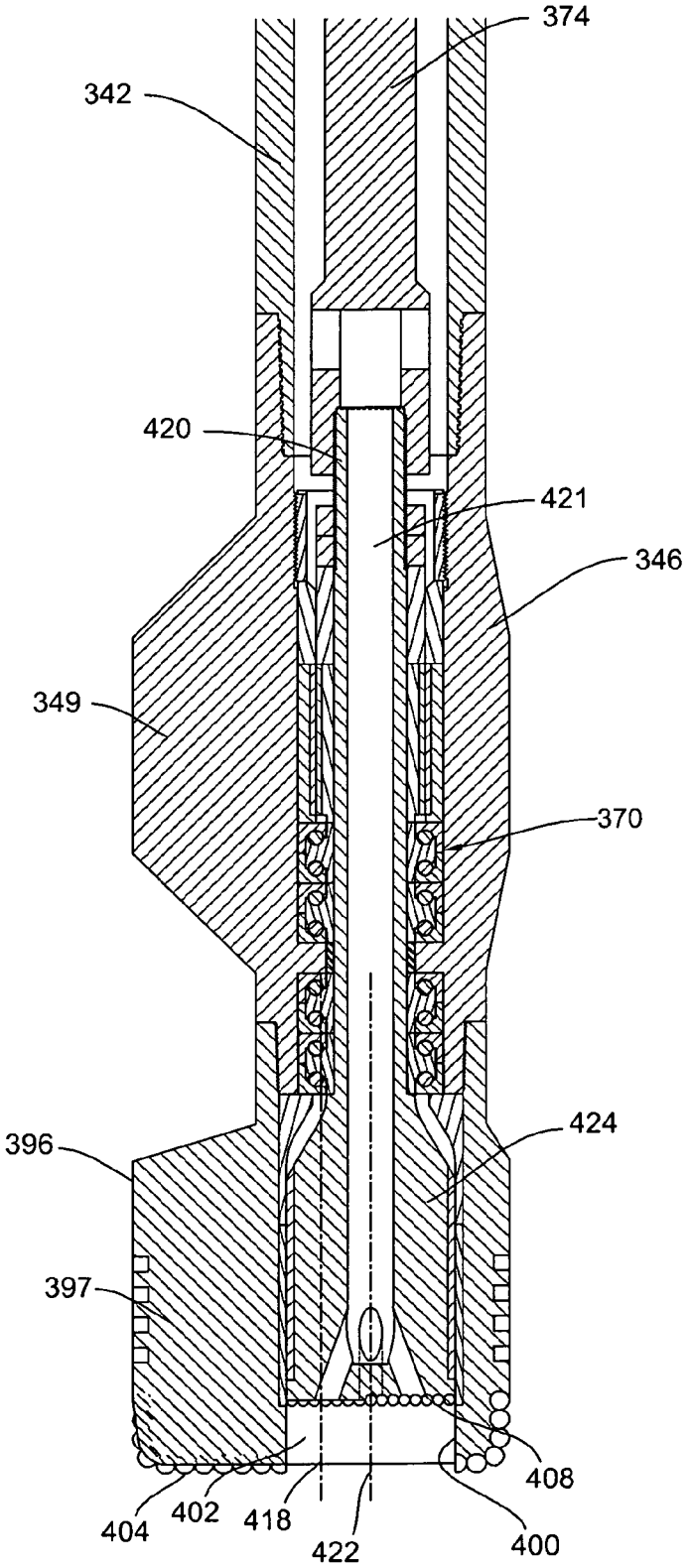
Figure 32:
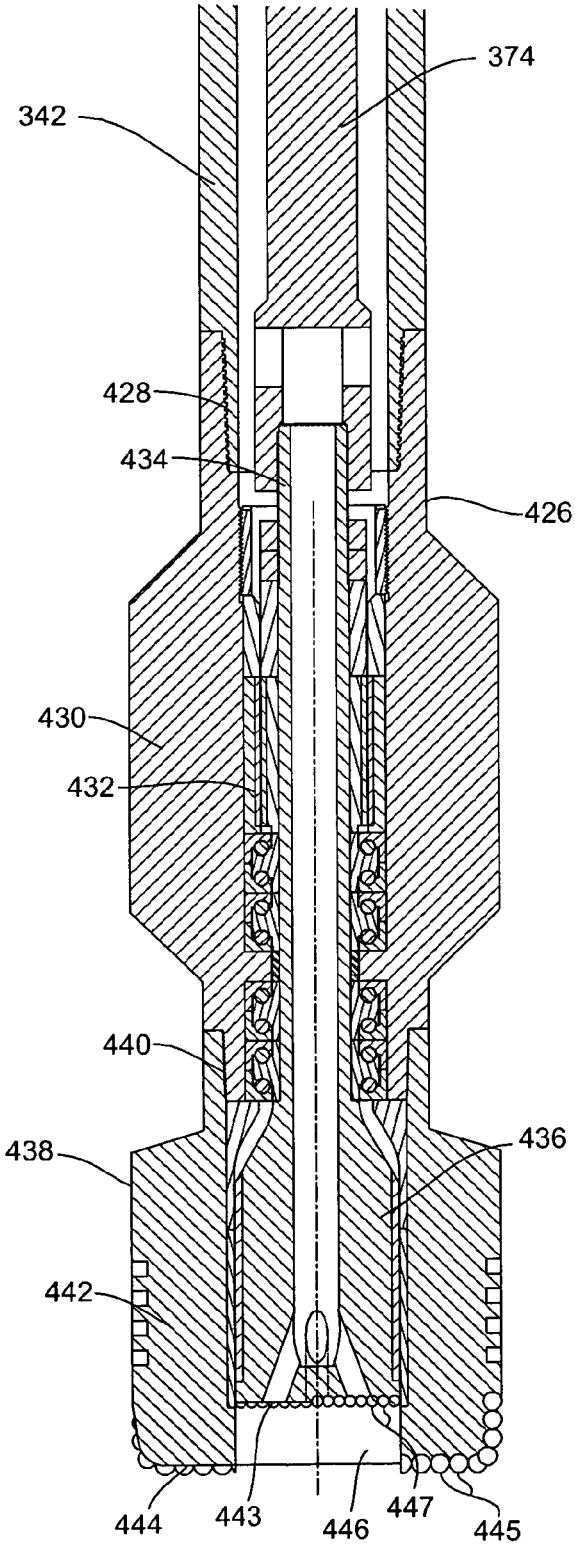
Figure 33:
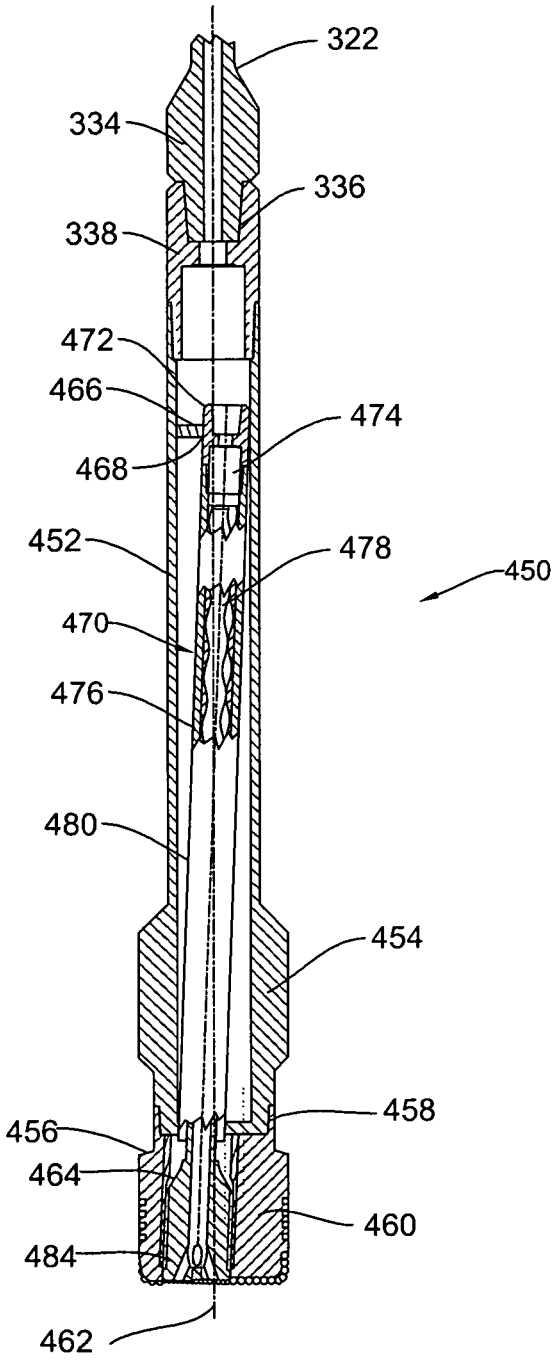
Figure 34:
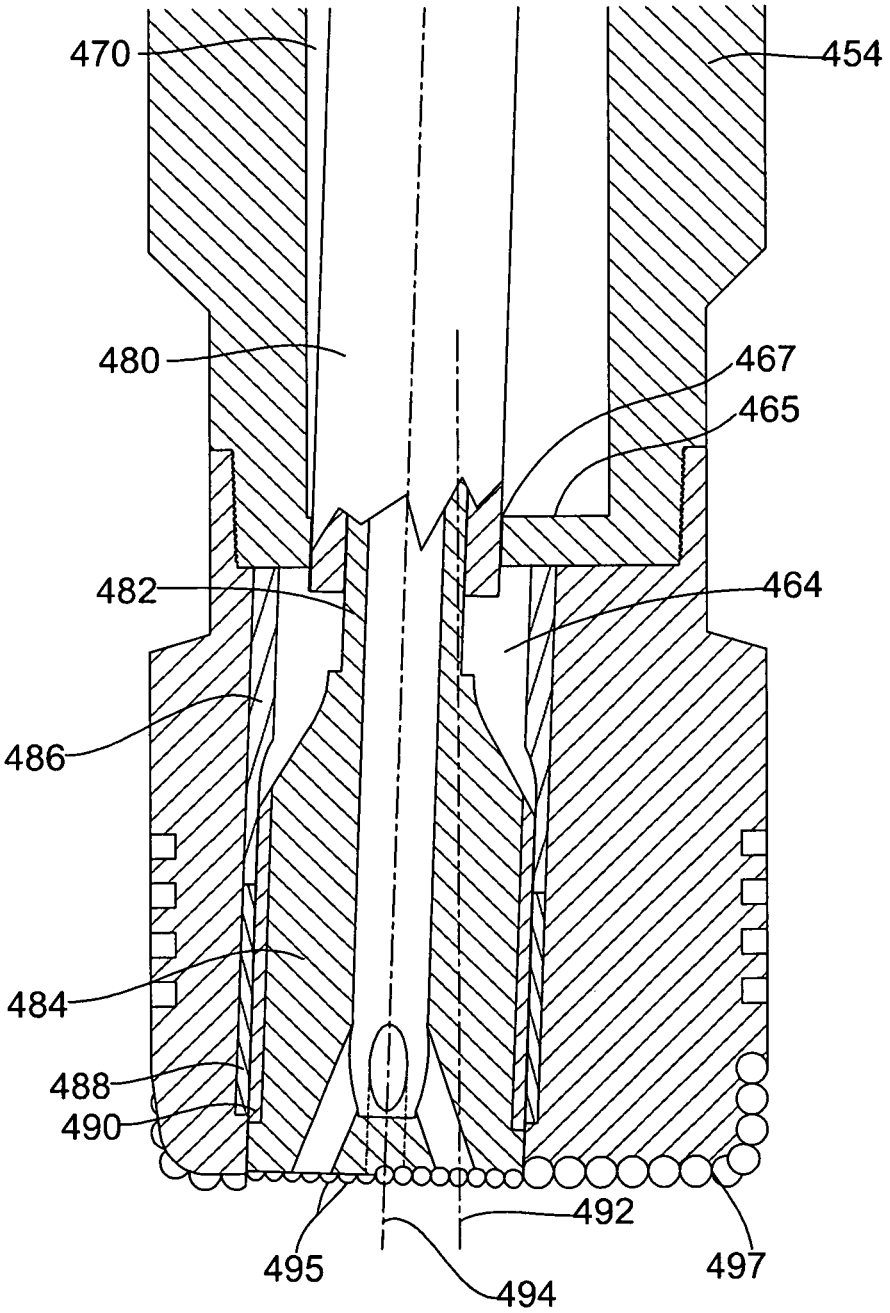
Figure 35:
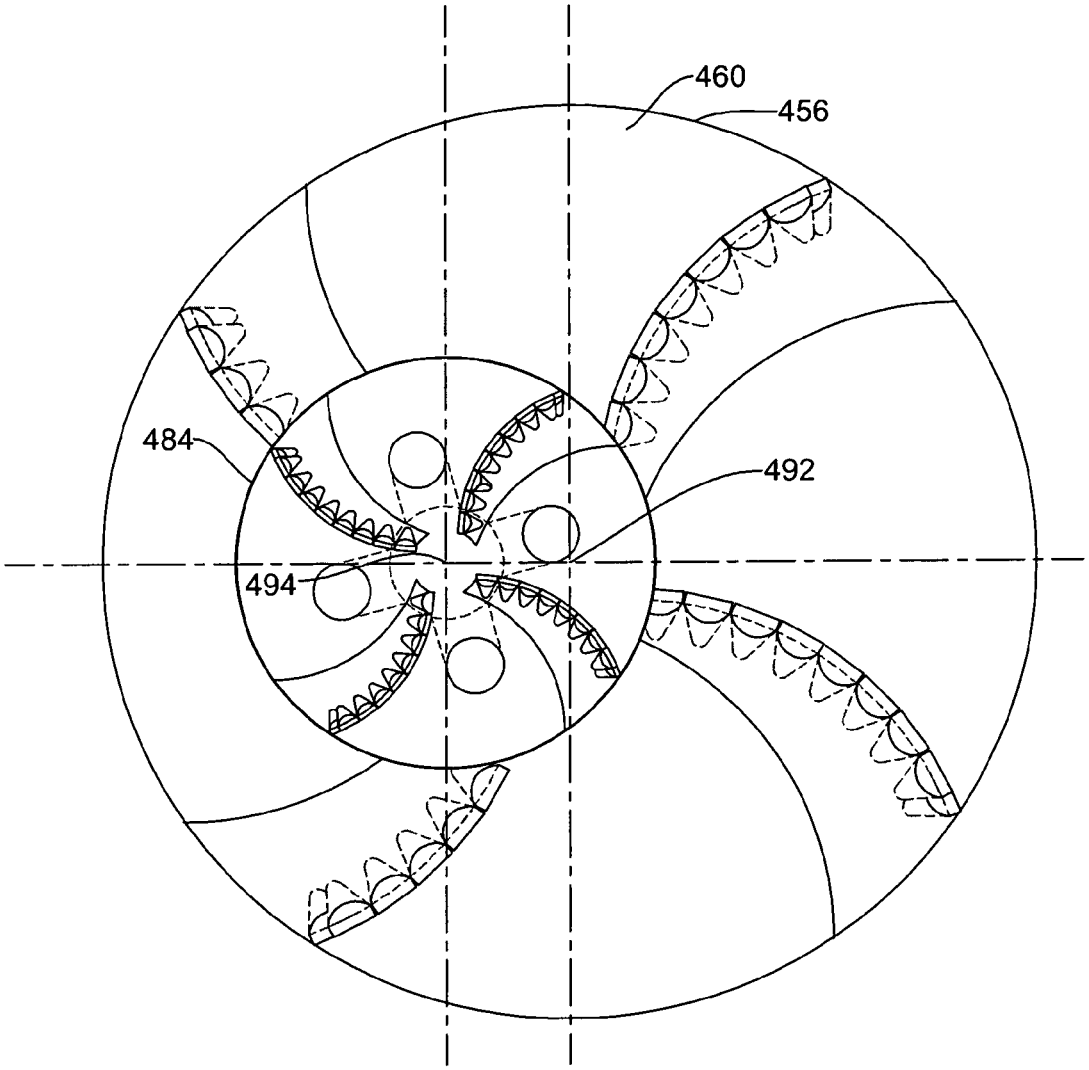
Figure 36:
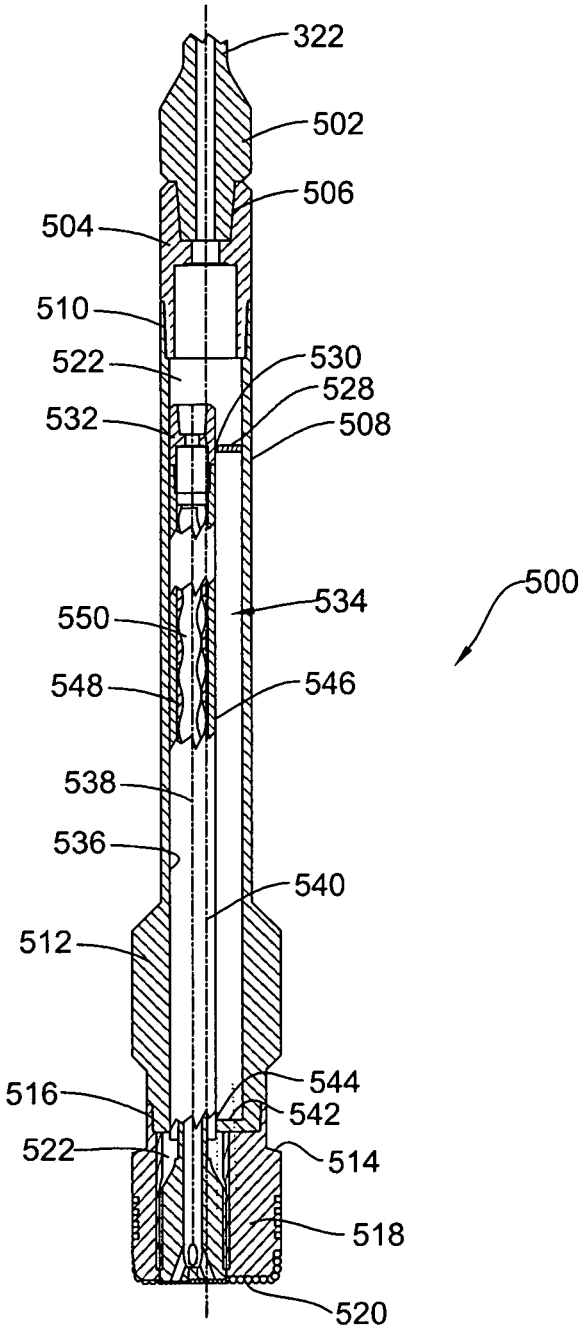
Figure 37:
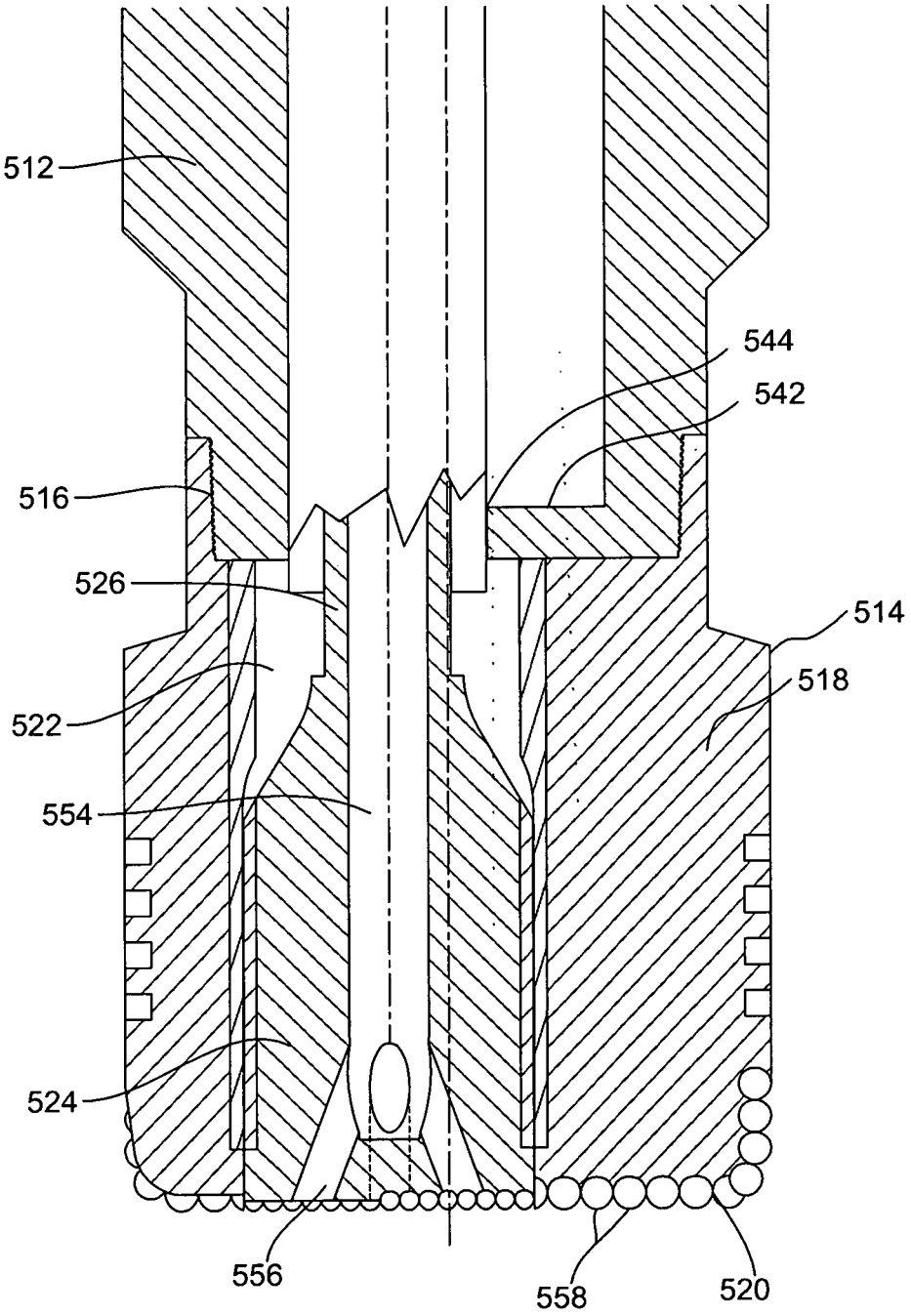
Figure 38:
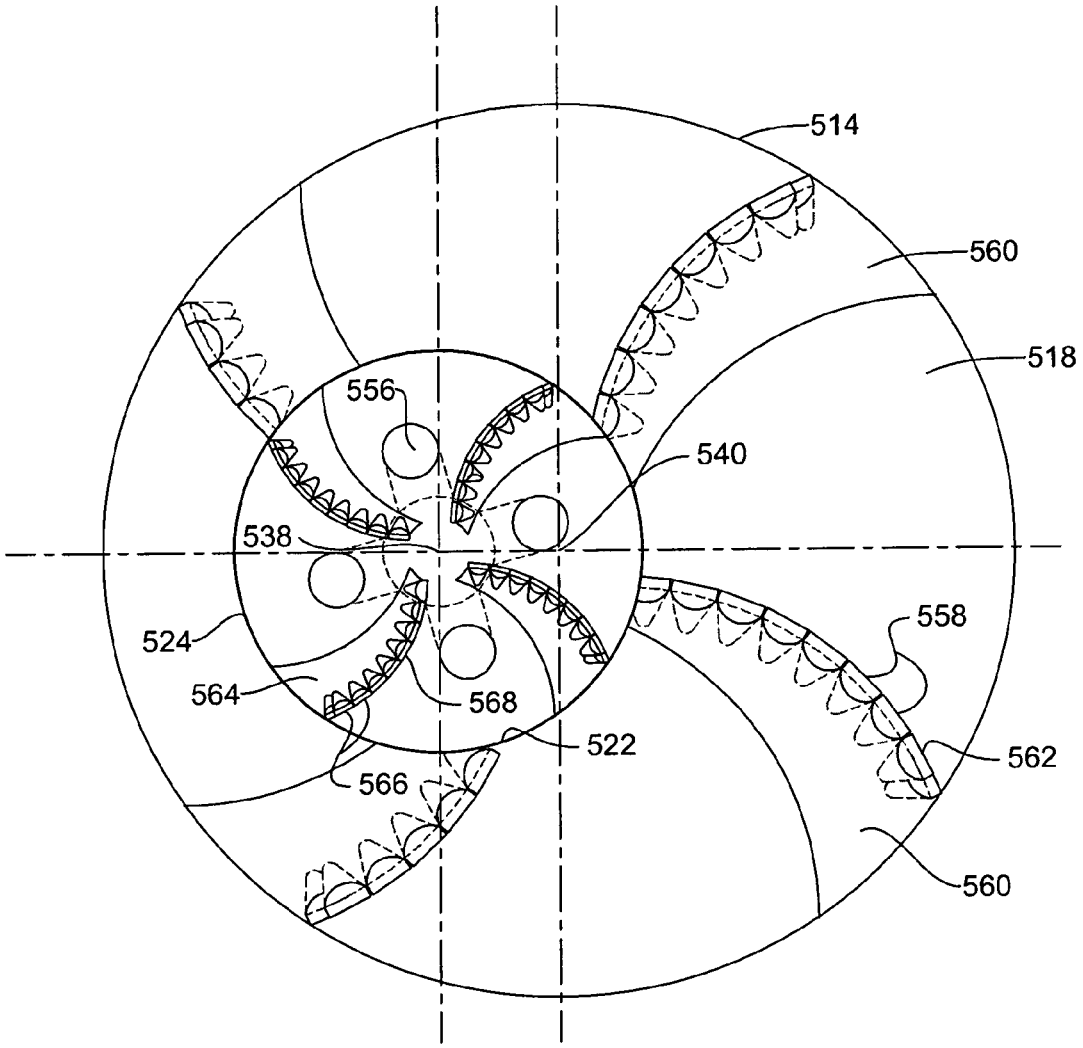

FIG. 8 is a longitudinal sectional view showing a dual speed, dual torque drilling mechanism of the present invention and further showing a secondary or inner drill bit having its lower formation cutting end in substantially co-extensive relation with the formation cutting end of the primary or outer drill bit and with the inner drill bit exposed for cutting engagement with a formation being drilled;

FIG. 9 is a longitudinal sectional view showing the lower portion of the dual speed, dual torque drilling mechanism of the present invention in greater detail;

FIG. 10 is a bottom view of the drilling system of FIGS. 8 and 9 and showing the secondary or inner drill bit of the drilling system relative to the primary or outer drill bit;

FIG. 11 is a longitudinal sectional view showing a drilling system embodying the principles of the present invention and particularly illustrating a recessed position of the secondary or inner drill bit within a passage of the outer drill bit;

FIG. 12 is a longitudinal sectional view showing the lower portion of the drilling system of FIG. 11 in greater detail;

FIG. 13 is a bottom view showing the dual speed, dual torque drilling system of FIGS. 11 and 12 and illustrating the eccentric relationship of the inner drill bit to the outer drill bit;

FIG. 14 is a longitudinal sectional view showing an alternative embodiment of the drilling system of the present invention and particularly illustrating a concentric and recessed position of the secondary or inner drill bit within a passage of the outer drill bit;

FIG. 15 is a longitudinal sectional view showing the lower portion of the drilling system of FIG. 14 in greater detail;

FIG. 16 is a bottom view of the dual speed, dual torque drilling system of FIGS. 14 and 15;

FIG. 17 is a longitudinal sectional view showing an embodiment of the present invention wherein the axis of rotation of the secondary or inner drilling bit is disposed in angular relation with the axis of rotation of the primary drilling bit;

FIG. 18 is a longitudinal sectional view showing the lower portion of the drilling system of FIG. 17 in greater detail;

FIG. 19 is a bottom view of the dual speed, dual torque drilling system of FIGS. 17 and 18;

FIG. 20 is a longitudinal sectional view showing the laterally offset relation of the axis of rotation of the inner drilling bit with respect to the axis of rotation of the outer drilling bit present invention and showing the eccentric relation of the inner drill bit with respect to the outer drill bit;

FIG. 21 is a longitudinal sectional view showing the lower portion of the drilling system of FIG. 20 in greater detail;

FIG. 22 is a bottom view of the dual speed, dual torque drilling system of FIGS. 20 and 21;

FIG. 23 is a longitudinal sectional view showing the upper hydraulic motor of an embodiment of the present invention which is designed for dual downhole motor driving the primary drill bit by a first hydraulic motor and driving the secondary drill bit with a second hydraulic motor;

FIG. 24 is a longitudinal sectional view showing the lower motor and dual speed, dual torque drill system of the present invention;

FIG. 25 is a longitudinal sectional view showing the dual speed, dual torque drill system of the present invention in greater detail;

FIG. 26 is a bottom view of the drilling system of FIGS. 23-25 showing in broken line the eccentric relation of the inner drill bit with respect to the outer drill bit;

FIG. 27 is a bottom view of the drilling system, similar to FIG. 26, and having a portion thereof broken away and shown in section to further illustrate the eccentric relation of the inner drill bit with respect to the outer drill bit;

FIG. 28 is a longitudinal sectional view showing the lower hydraulic motor of an embodiment of the present invention similar to the embodiment of FIGS. 23-25 and having dual downhole motors for independent driving of the primary and secondary drill bits drill bit by a first hydraulic motor and driving the secondary drill bit with a second hydraulic motor;

FIG. 29 is a longitudinal sectional view showing the lower portion of the dual speed, dual torque drilling system of FIG. 29 in greater detail;

FIG. 30 is a bottom view of the drilling system of FIGS. 28-29 showing the eccentric relation of the inner drill bit with respect to the outer drill bit;

FIG. 31 is a longitudinal sectional view showing the lower portion of a dual speed, dual torque drilling system similar to that of FIG. 29 and having an inner drill bit that is recessed within an inner drill bit chamber of the outer drill bit;

FIG. 32 is a longitudinal sectional view showing the lower portion of a dual speed, dual torque drilling system having a concentrically located and recessed inner drill bit within an outer drill bit;

FIG. 33 is a longitudinal sectional view showing the lower portion, including the secondary hydraulic motor of a dual speed, dual torque drilling system and illustrating the inclined relation of the axis of rotation of the secondary drill motor and secondary drill bit with respect to the axis of rotation of the primary hydraulic motor and the axis of rotation of the primary drill bit;

FIG. 34 is a longitudinal sectional view showing the lower portion of the drilling system of FIG. 33 in greater detail;

FIG. 35 is a bottom view of the drilling system of FIGS. 33 and 34 showing the eccentric relation of the inner drill bit with respect to the outer drill bit;

FIG. 36 is a longitudinal sectional view showing the lower portion of a dual speed, dual torque drilling system having primary and secondary hydraulic motors for independently driving outer and inner drill bits and wherein the secondary hydraulic motor is arranged in parallel, laterally offset relation with the axis of rotation of the primary hydraulic motor;

FIG. 37 is a longitudinal sectional view showing the lower portion of the drilling system of FIG. 36 in greater detail; and FIG. 38 is a bottom view of the drilling system of FIGS. 36 and 37.

DETAILED DESCRIPTION OF PREFERRED EMBODIMENT

Figure 1:
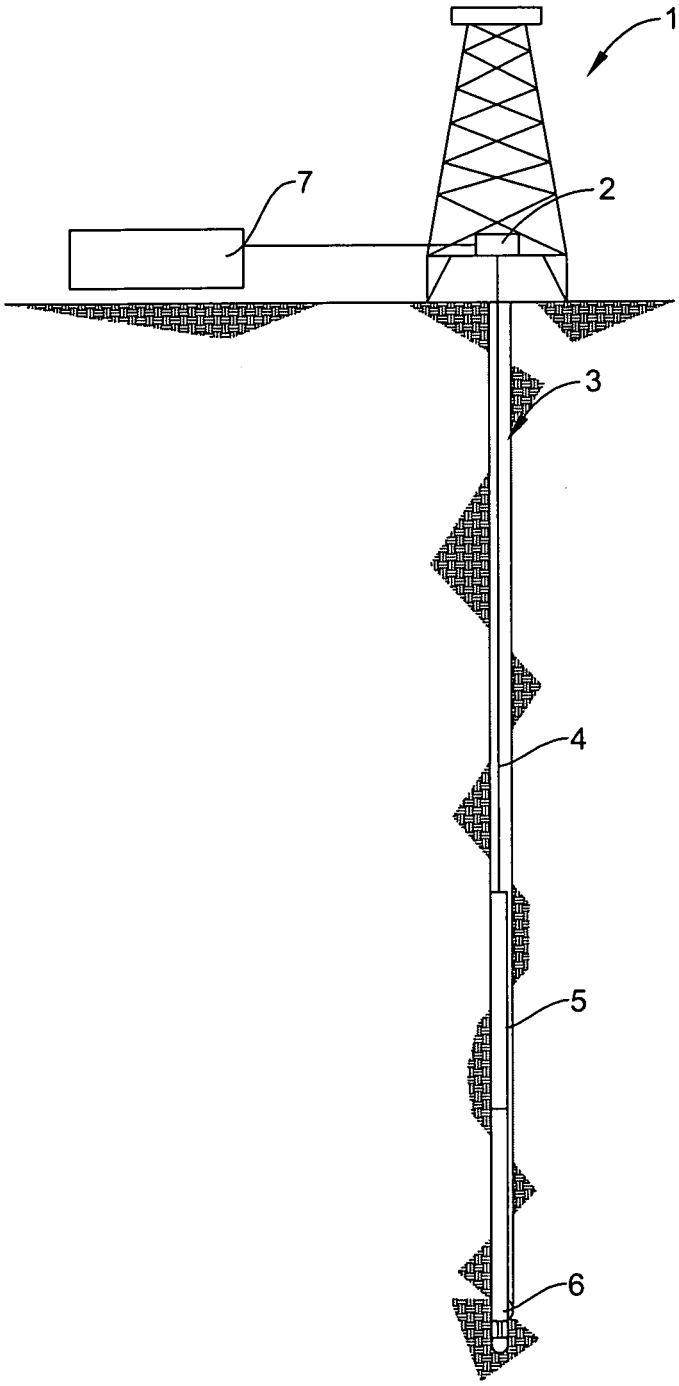
Figure 2:
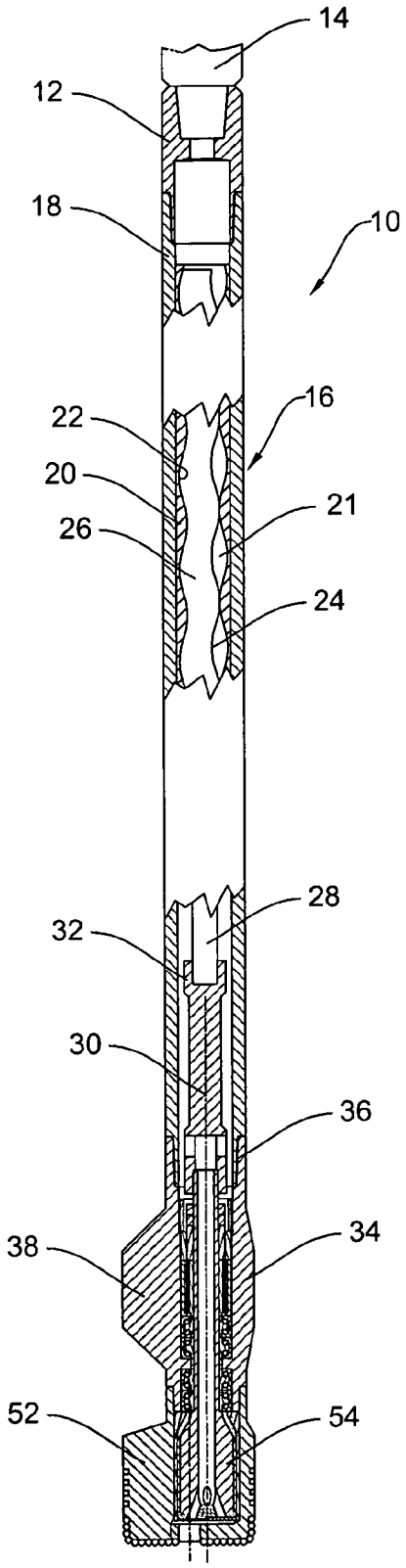

Referring now to the drawings and first to FIG. 1, a well drilling rig is shown generally at 1 and is provided with a rotary drive mechanism 2 that imparts rotary drive motion to a drill string shown generally at 3 which is composed of multiple sections of drill pipe 4 that are threaded together. A drilling unit 5 is typically connected at the lower end of the drill string 3. The drilling unit 5 may be in the form of a drill collar when the drill string is rotated or it may be in the form of a fluid pressure energized turbine or mud motor when drilling is accomplished by a non-rotatable drill string and with a drill bit system 6 being driven by the force of flowing drilling fluid. In this case the flowing drilling fluid is pressurized by one or more pumps 7 of the drilling rig and is conducted through the tubular drill string to the drill bit system for the purpose of cooling the drill bit and for transporting drill cuttings from the site to drilling activity to the surface. The drill string may be rotatable by a rotary drive mechanism 2 for rotating a primary drill bit that is connected to the lower end of the drill string. In the alternative, the drill bit may be rotated by a fluid energized turbine or mud motor that is driven by the motive force of the drilling fluid being pumped from the surface by the drilling fluid supply and pump system 7. Thus, when a turbine or mud motor is employed the fluid pump system provides for hydraulic energization of the drill bit apparatus and also provides for cooling of the drill bit and for transportation of drill cuttings to the surface.

According to the preferred embodiment of the present invention the horsepower of a primary rotary drive mechanism, being powered by the rotary drive mechanism 2 at the surface, is employed to drive a primary or outer drill bit. Simultaneously the horsepower of the hydraulic system of the drilling rig, i.e., the drilling fluid pumps 7 and the hydraulic fluid control mechanism, is employed to provide for separate rotary driving of a secondary or inner drill bit of the drilling assembly. This feature essentially provides the full horsepower of the mechanically energized rotary drive mechanism of the drill string and the full horsepower of the fluid energized rotary drive mechanism for the simultaneous energization of the outer and inner drill bits of the drill bit assembly. Moreover, this feature also permits the outer and inner drill bits to be rotated at different speeds and different directions of rotation as desired. The present invention therefore provides a dual speed, dual torque arrangement for highly efficient drilling.

The drilling system of the present invention employs a dual speed, dual torque power system and employs a method which drills a center, centerless borehole with the inner drill bit moving in an orbital pattern and using a high inner bit rotating speed. The inner drill bit is movable in an orbital pattern for efficiently cutting away the central portion of the formation material primarily due to the offset relation of the inner drill bit with the outer drill bit. The outer drill bit can be offset with respect to its axis or rotation or the inner drill bit can be laterally offset or eccentric with respect to the axis of rotation of the outer drill bit. Alternatively, the outer and inner drill bits can be arranged concentrically, with the outer drill bit removing a major portion of the formation material, without drilling at the central portion of the borehole, while the inner drill bit is rotated at the same or different speed and the same or different direction or rotation to effectively remove the centermost portion of the formation material.

With reference to FIGS. 2-5 a dual speed, dual torque drilling system representing the preferred embodiment of the present invention is shown generally at 10 and incorporates a cross-over sub 12 at its upper end for connection of the drilling system to a drill string 14. The cross-over sub directs at least a portion of the drilling fluid flow to and through a turbine or positive displacement fluid energized rotary motor, collectively referred to as a "hydraulic motor" or "mud motor", shown generally at 16 which constituting a "power section" of the downhole drilling unit. The power section comprises a motor housing 18 having or defining an internal stator 20 which defines a central passage 21 and has a generally helical internal stator profile or geometry 22 that matches an external profile 24 of a rotor member 26. The elongate stator member 20 is preferably composed of a resilient material, such as molded rubber or rubber-like polymer as is typical of the well drilling industry. The flow of drilling fluid through spaces between the rotor and stator provide hydraulic forces that cause the rotor to rotate within the central passage 21 of the stator. These forces impart driving rotation to a rotor output shaft 28, which is in turn coupled in rotary driving relation with a power transmission flex shaft 30 by means of a coupling 32. For rotation of a primary drill bit, which is discussed below the tubular motor housing 18 is rotatably driven by the drill string from the surface. A stabilizer sub 34 is secured by a threaded connection 36 to the lower end of the tubular motor housing 18 and defines an eccentric stabilizer 38 that serves to minimize lateral movement of the lower dual drill bit mechanism of the drilling system 10 with respect to the wall surface of the borehole being drilled. The eccentric stabilizer 38 defines a plurality of spaced radiating blades as is typical in the well drilling industry, with the spaces between the blades serving as drilling fluid return passages for upward flow of drilling fluid and drill cuttings to the surface.

Figure 3:
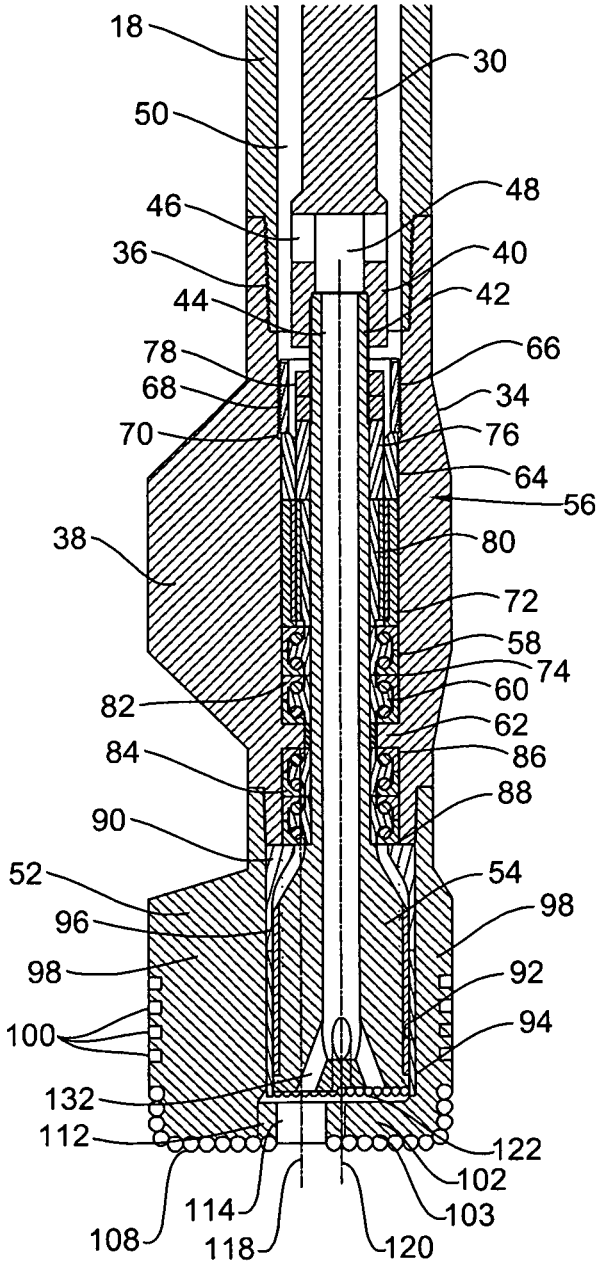

As shown best in FIG. 3 the flex shaft 30 is provided with a coupling 40 at its lower end which is disposed in driving relation with a tubular inner bit mandrel 42, the central passage 44 of which conducts flowing drilling fluid downwardly for cooling the inner and outer drill bits and for carrying away drill cuttings that have been cut away from the formation material by the dual drill bits. Transverse and vertical passages 46 and 48 of the coupling 40 communicate flowing drilling fluid from an annulus 50 that is located externally of the power transmission flex shaft 30 and internally of the tubular housing 18 and internally of the stabilizer sub 34. Discharge of drilling fluid from the mud motor will flow through the annulus 50 and through the lateral passage 46 and vertical passage 48 to the central passage 44 of the tubular bit drive mandrel 42 for the purpose of cooling of the cutting faces and cutting elements of a primary or outer drill bit 52 and a secondary or inner drill bit 54, discussed in detail below, and transporting drill cuttings from the immediate vicinity of the cutting elements of both drill bits. As discussed herein the cutting elements on the cutting faces of the inner and outer drill bits may be described as PDC cutting elements such as will typically be employed for drilling in relatively hard formation material. It is to be understood, however, that the spirit and scope of the present invention is applicable to a wide range of differing formation cutting or drilling elements, such as various hardened metal materials, carbide inserts and the like and thus is not intended to be limited to drill bits having PDC cutting elements.

Within the stabilizer sub 34 of the drilling system is provided a bearing chamber shown generally at 56 which contains bearing assemblies to provide for rotary support of the secondary or inner rotary bit 54, which may also be described as a "core removal bit". The bearing assembly which is shown generally at 56 has upper and lower bearing packs, the upper bearing pack 58 being secured relative to the upper annular shoulder 60 of an internal flange 62 of the bearing chamber 56 by an upper bearing pack outer compression spacer 64. An upper bearing jam collar 66 is mounted within the bearing chamber 56 by a threaded connection 68 and serves to secure the upper bearing outer compression spacer against an internal annular shoulder 70. The outer compression spacer 64 of the upper bearing pack engages and retains an outer radial bearing assembly 72 and a thrust bearing assembly 74 of the upper bearing pack.

An inner compression spacer 76 of the upper bearing pack assembly is secured relative to the tubular inner bit mandrel 42 by drilling fluid flow through tube lock nuts 78 to maintain desired positioning of an inner radial bearing pack member 80 that in turn bears against and secures an upper thrust bearing assembly 82 in seated relation with the annular shoulder 60. Below the annular internal flange 62 is located a lower thrust bearing assembly 84 that is retained against a lower annular shoulder 86 of the annular internal flange 62 by the upwardly facing shoulder 88 of a bearing retainer 90. The bearing retainer 90 extends into an inner drill bit chamber 92 of the primary or outer drill bit 52 and is in turn supported in place by a spacer member 94. The bearing retainer and spacer member are preferably composed of a hardened or wear resistant material such as Stellite or any of a number of commercially available hard-facing materials. The secondary or inner rotary bit member 54 is shown to have a generally cylindrical external configuration which is defined by an exterior layer or coating 96 of wear-resistant material. The inner drill bit 54 may be formed integrally with the tubular inner bit mandrel 42 as shown, or if desired may be connected with the tubular inner bit mandrel by a threaded connection, by welding or my any other suitable means. The upper end of the tubular inner bit mandrel may be threaded to the coupling 40 or may be secured in any other manner that will permit the rotatable power transmission flex shaft 30 to rotate the tubular inner bit mandrel 42 and the inner rotary bit member 54.

Figure 4:
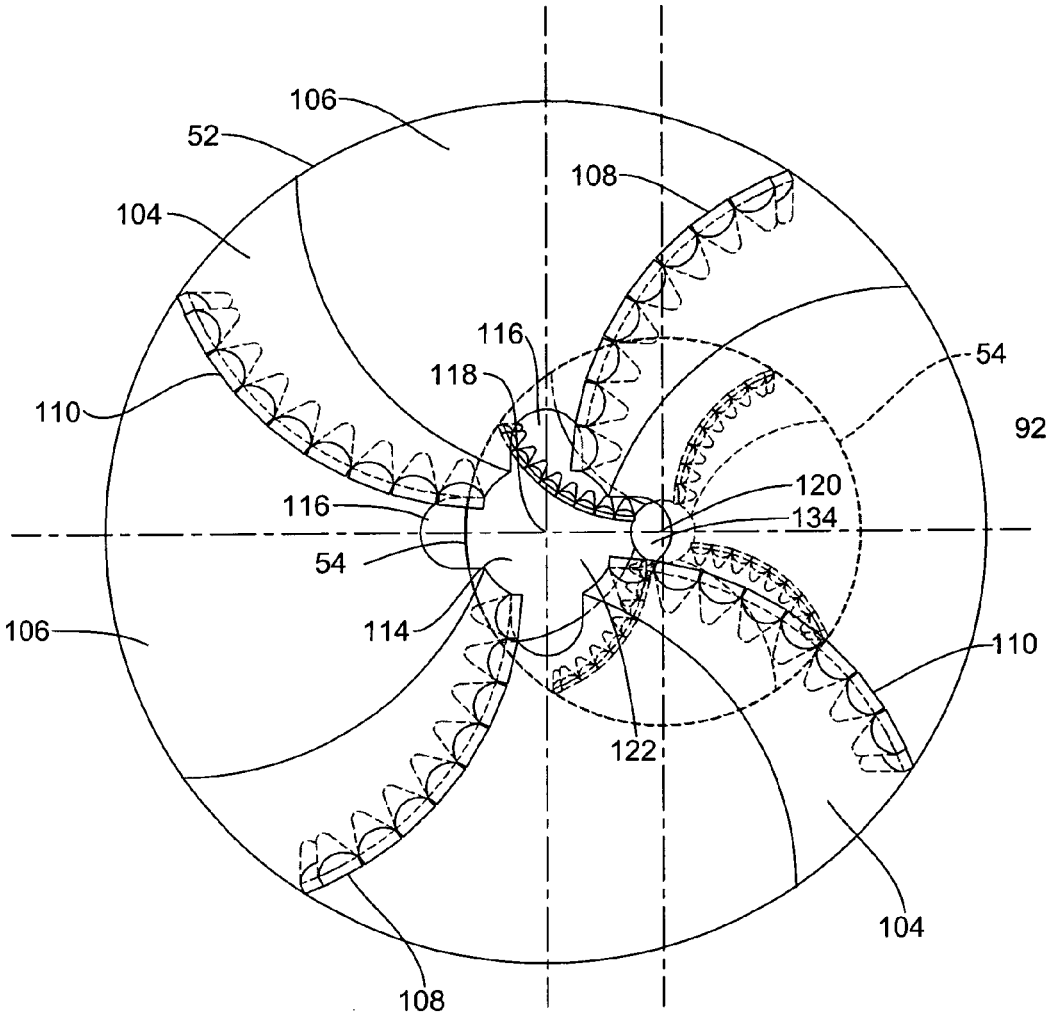

As shown in FIGS. 3 and 4, the primary or outer drill bit member 52 defines a side wall structure 98 having embedded there a multiplicity of wear resistant gauge elements 100 that minimize wear of the outer portion of the drill bit as it is rotated within the borehole of the formation that is being drilled. The drill bit body structure also defines a bottom wall structure 102 having a cutting face 103 forming a plurality of radiating lands 104 and grooves 106. A multiplicity of polycrystalline diamond cutter (PDC) members 108 are mounted to leading edges 110 of the lands and are oriented for cutting engagement with the formation material being drilled as the outer drill bit is rotated by the drill string of by any other rotary drive mechanism. The lands and grooves extend to the outer annular corner 112 and lower portions of the side wall of the primary drill bit 52 and also have leading edges to which are mounted PDC cutter elements as shown in FIG. 3. It should be borne in mind that the spirit and scope of the present invention are effectively achieved by the use of other types of formation cutting elements, such as embedded diamonds and various types of hardened metal material and hardened inserts. Thus it is not intended to limit the present invention to the use of PDC cutting elements.

The bottom wall structure 102 of the primary drill bit 52 defines a central opening 114 of generally circular configuration and further defines a plurality of lateral relief areas 116 that extend from the central opening and provide for drilling fluid flow during drilling activity. During rotation of the primary drill bit 52 about its axis of rotation 118 in response to rotation of the drill string, since no formation cutting elements 108 are located at the center portion of the cutting face 103 due to the presence of the central opening 114, a small core of uncut formation material will be present within the central opening. The lateral relief areas 116 will provide for the flow of drilling fluid past this small core and will provide for cooling of the cutting elements and the cutting face and will also transport drill cuttings away from the formation material being drilled.

Figure 5:
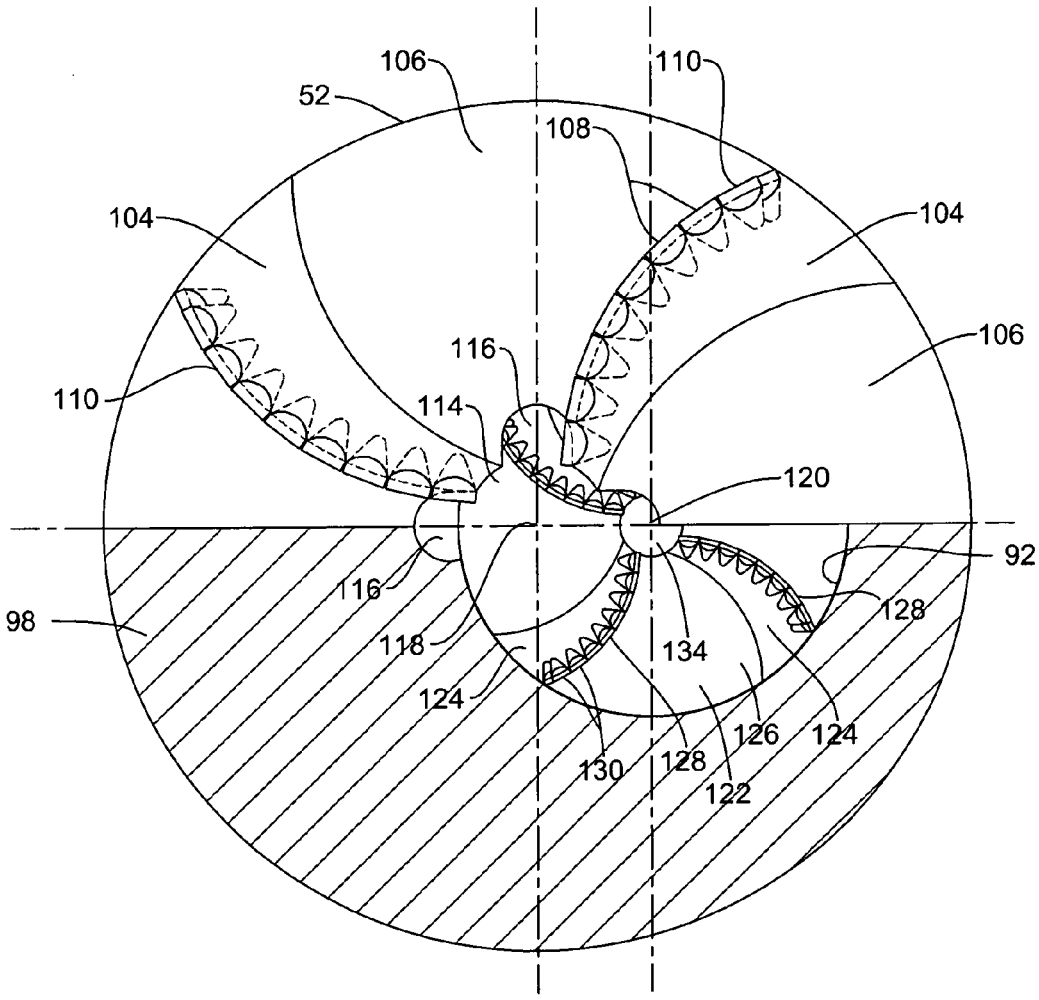
Figure 7:
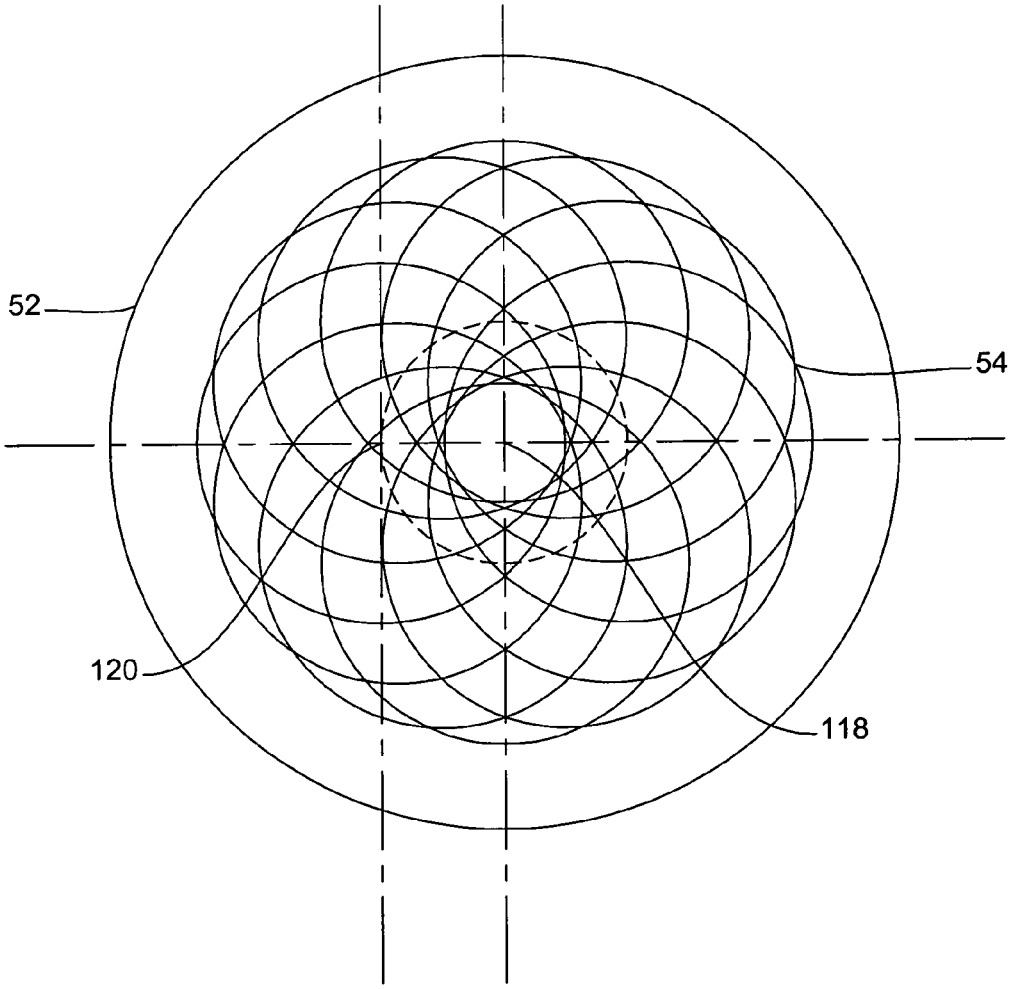

As is also shown in the longitudinal sectional view of FIG. 3 and the bottom views of FIGS. 4 and 5, the inner bit chamber 92 is positioned with its center in laterally offset relation with the axis of rotation 118 of the outer drill bit and forms an axis of rotation 120 of the secondary or inner drill bit 54. Since the axes of rotation of the outer and inner drill bits are laterally offset, the inner drill bit will have orbital movement about the axis of rotation 118 of the outer drill bit simultaneously with rotation about its axis of rotation 120. This feature will cause the inner drill bit to have a pattern of movement relative to the outer drill bit 52 as shown in the schematic illustration of FIG. 7. The circular broken line in FIG. 7 represents the path of the axis 120 of the inner drill bit 54 during a single revolution of the outer drill bit 52. The multiple overlapping circles show multiple orbital positions of the inner drill bit relative to the outer drill bit during a revolution of the outer drill bit. It should be borne in mind that, at each of these multiple orbital positions of the inner drill bit, an outer portion of the inner drill bit extends across the central opening 114.

Figure 6:
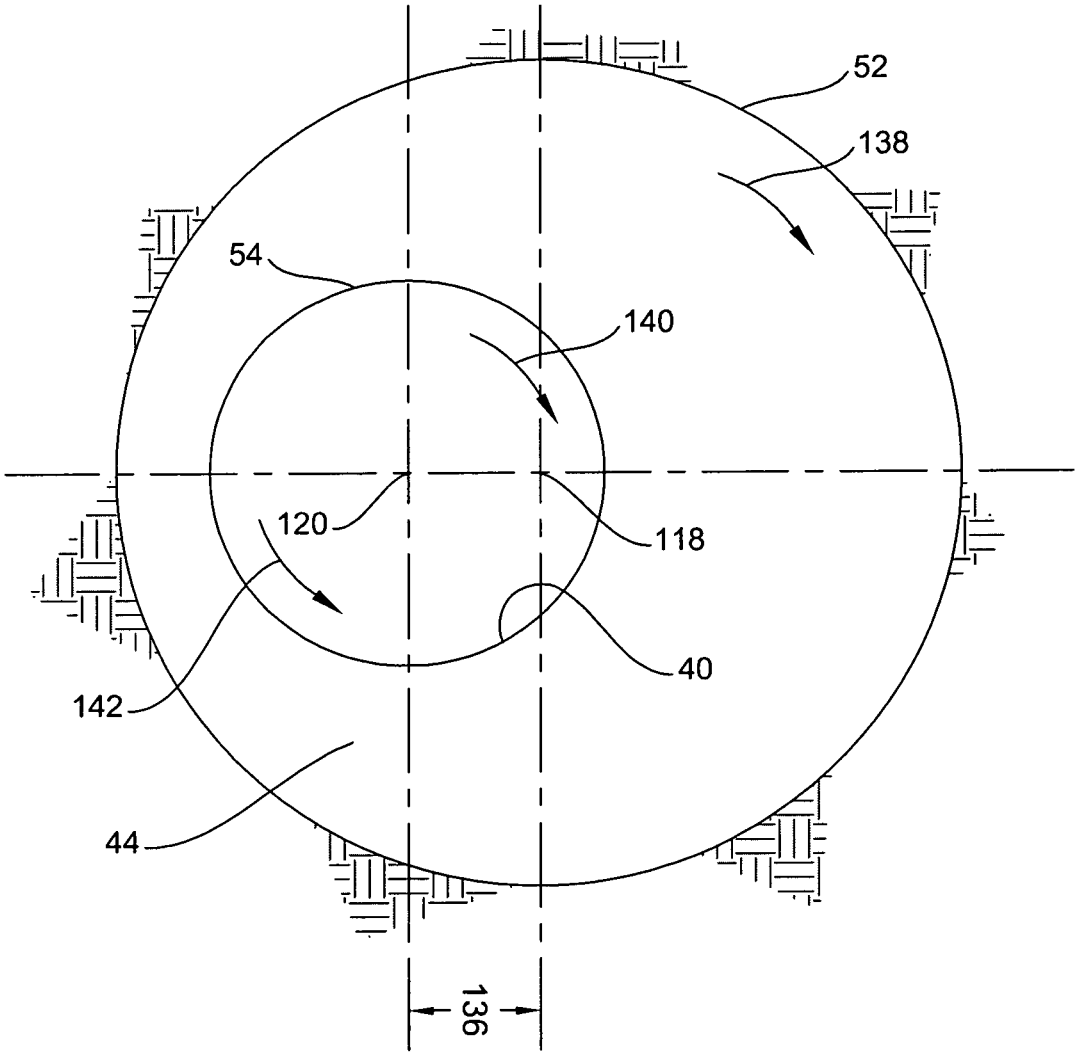

As best shown in FIG. 5, the secondary or inner drill bit 54 has a bottom portion forming a cutting face 122 that defines a plurality of radiating, curved lands 124 having grooves 126 therebetween. The leading edges 128 of the lands 124 are mounted a multiplicity of formation cutting elements 130 such as PDC cutters. The fluid passage 44 of the inner bit mandrel 42 may be branched within the inner drill bit as shown at 132 in FIG. 3 to provide for even distribution of drilling fluid throughout the cutting face 122 or may terminate at a single drilling fluid discharge opening or nozzle 134. In the schematic illustration of FIG. 6 the axis of rotation of the primary or outer drill bit 52 is shown at 118 and the axis of rotation of the secondary or inner drill bit 54 is shown at 120. The distance 136 between these axes will determine the orbital excursion of the inner drill bit relative to the outer drill bit. The rotation arrow 138 illustrates the clockwise rotary motion of virtually all drilling systems while the opposed rotation direction arrows 140 and 142 indicate that the rotary direction of the inner drill bit may be selectively rotated clockwise or counter-clockwise as desired. Also, being independently driven, the inner drill bit may be rotated at any desired speed without regard to the speed of rotation of the outer drill bit. Typically the inner drill bit will be driven much faster that the outer drill bit, such as from 2 to 8 times faster than the rotational speed of the outer drill bit and in either direction of rotation as is deemed appropriate for the character of drilling that is desired.

With reference to FIGS. 8-10 a dual speed, dual torque drilling system is shown generally at 150 and having like components that are indicated by like reference numerals as compared with the preferred embodiment of FIGS. 2-5. To the stabilizer sub 34 is mounted a primary or outer drill bit shown generally at 152 having a drill bit body 154 which defines a generally cylindrical inner drill bit chamber or passage 156 that is open to the cutting face 158 of the outer drill bit and defines a generally circular opening 160 that is laterally offset in relation to the axis or rotation 162 of the primary drill bit 152. Formation cutting elements 164 are mounted to the leading edges 165 of radiating curved lands 166 of the primary drill bit in the manner that is described above.

A secondary or inner drill bit shown generally at 168 is supported for rotation by the inner bit mandrel 42 and the bearing assembly 56 for rotation by the hydraulic motor 16 within the inner drill bit chamber or passage 156 of the outer drill bit 152. The inner drill bit defines a cutting face 170 that is defined by a plurality of spaced, curved radial lands 172 and spaced grooves or relief areas 174 defined between the lands. The lands 172 define leading edges 176 having a multiplicity of inner bit cutting elements 178 being mounted thereto in position and orientation for cutting away an inner region of formation material as the inner bit is rotated independently of the outer drill bit about its axis of rotation 161 as it is simultaneously rotated orbitally about the axis 162 of rotation of the outer drill bit. It should be borne in mind that the orientation of the curved radiating lands will determine the direction of rotation of the inner drill bit as it cuts away the inner region of the formation material of the borehole. If the direction of inner bit rotation is opposite that of the outer drill bit then the orientation of the curved radiating lands and the location of the leading edges of the lands will be opposite that of the outer drill bit. The fluid flow passage 44 of the inner bit mandrel 42 is intersected by a plurality of angulated branch fluid distribution passages 179 that intersect the cutting face 170 and ensure adequate flow and distribution of drilling fluid to both the inner drill bit and the outer drill bit. Since the central portion of the formation material is continuously cut away by the inner drill bit, the outer drill bit is enabled to achieve efficient cutting of the majority of the formation material and the dual speed, dual torque drilling system will penetrate the formation material at a greater rate and will run much cooler than is currently possible with standard PDC drill bits and will have significantly extended service life.

In FIGS. 11-13 a dual speed, dual torque drilling system is shown generally at 180 which differs from the drilling system of FIGS. 8-10 in that the inner drill bit is recessed within the inner bit chamber of the outer drill bit rather than having its cutting face oriented substantially co-extensive or flush with the cutting face of the outer drill bit. As shown, an outer drill bit shown generally at 182 has an outer bit body 183 that is mounted to the stabilizer sub 34 by a threaded connection 184 and defines an axis of primary drill bit rotation 186. A secondary or inner drill bit 188, being integral with the inner bit mandrel 42 or connected with it in any suitable manner, is rotatable within an inner bit chamber 190 of the outer drill bit body 183 about an axis of rotation 191 as the mandrel 42 is rotated by the hydraulic motor 16 in response to the flow of drilling fluid through the hydraulic motor. The inner drill bit defines a cutting face 192 having lands, grooves and formation cutting elements as described above in connection with FIGS. 8-10, the cutting face being retracted or located inwardly of the cutting face 194 of the outer drill bit as best shown in FIG. 12. During rotation of the outer drill bit by the drill string of the well drilling system the formation cutting elements of the outer drill bit will cut away a major portion of the borehole material and will leave a central portion of the formation material uncut. The secondary or inner drill bit 188 is rotated independently of the primary or outer drill bit 182 by the hydraulic motor 16 as it is simultaneously rotated orbitally due to the laterally offset position of its axis of rotation 191 in relation to the axis of rotation 186 of the outer drill bit. This rotational and orbital movement causes the inner drill bit to efficiently cut away the central portion of the formation material without developing the heat that is typically generated when standard PDC drill bits are used for drilling in relatively hard formation materials. Since heat generation is minimized by the dual speed, dual torque drilling system of the present invention, the drilling system is provided with exceptionally extended service life, thus minimizing the cost of the drilling operation and providing for drilling at an exceptional rate of penetration.

Referring now to FIGS. 14-16, a dual speed, dual torque drilling system is shown generally at 200 and differs from the embodiment of FIGS. 11-13 only in that the primary drill bit shown generally at 202 which is mounted to the stabilizer sub 34 by a thread connection 204. The stabilizer sub 34 defines a stabilizer body member 206 that is oriented in concentric relation with the tubular housing 18 and defines an axis of primary drill bit rotation 208. The primary drill bit 202 defines a drill bit body 210 having an inner drill bit chamber 212 within which a secondary or inner drill bit 214 is supported for rotation by the inner bit mandrel 42 and bearing assembly 56. The inner drill bit chamber 212 is located concentrically within the body 210 of the outer drill bit 202. The inner drill bit is supported so as to be rotatable about an axis that is disposed in co-axial relation with the axis of rotation 208. Thus, the inner drill bit of this embodiment is not subject to orbital movement as the outer drill bit is rotated. Rather, the inner drill bit is rotatable about a common axis of rotation with the outer drill bit and is rotatable in the same direction as that of the outer drill bit or the opposite direction of rotation, depending on the needs of the user.

To minimize the excessive heat generation problem of conventional drill bits, which results from poor formation cutting characteristics of the cutting elements that traverse the central portion of a borehole being drilled at a much slower cutting speed than is desirable, the drilling system set forth in FIGS. 14-16 permits each portion of the cutting faces of the outer and inner drill bits to have an efficient range of cutting speed. The primary or outer drill bit has a cutting face 216 that is arranged to cut away a major portion of the formation material to form the borehole. Simultaneously, the secondary or inner drill bit is oriented so that the cutting elements of its cutting face 218 engage a smaller central region of the formation material being drilled and is rotated independently of the outer drill bit so that the speed of the cutting elements relative to the formation material is optimum for efficient cutting of the formation material, without causing excessive generation of heat. The inner drill bit is typically rotated at a much faster speed as compared with the rotational speed of the outer drill bit so that its cutting elements efficiently remove the central portion of the borehole formation material. Thus, the outer and inner drill bits each perform optimally for cutting the formation material across the combined cutting face areas of each drill bit so that the resulting speed of drill bit penetration into the formation material is materially enhanced in comparison with the speed of drill bit penetration when a standard drill bit is employed. Moreover, the inner drill bit can be rotated clockwise or counter-clockwise by selectively designing its hydraulic motor to produce the desired direction of drill bit rotation in response to the flow of drilling fluid through the drilling system.

The embodiment of FIGS. 17-19 illustrates a dual speed, dual torque drilling system generally at 220 having a tubular housing 18 that is a component of the drill string 3 and is rotated by the rotary drive mechanism 2 of the drilling rig 1. Within the tubular housing 18 is provided a support structure 222 having an opening 224 within which is supported a cross-over sub 226 that defines the upper end portion of a tubular housing 228 of a hydraulic motor shown generally at 230 which is preferably of the same type as shown at 16 in FIG. 2. A stabilizer member 232 may be formed integrally with the tubular housing 18 so as to form a stabilizer sub or may be connected with the tubular housing in any suitable manner. An outer drill bit, shown generally at 234 has a drill bit body 236 that is mounted to the stabilizer 232 by a threaded angular relation with respect to the center-line or axis of rotation 242 of the outer drill bit 234. The hydraulic motor 230 is oriented angularly within the tubular housing 18 corresponding with the angular orientation of the primary or inner bit chamber 240.

A secondary or inner drill bit 244 which has a cylindrical side wall that is clad with wear resistant material 246, such as is described above and shown at 96 in FIG. 3, is rotatably driven by an inner bit mandrel 248 corresponding to mandrel 42 in FIG. 3, about an axis of inner bit rotation 250 that is oriented in angular relation with respect to the axis of orientation 242 of the outer drill bit. The inner drill bit has a cutting face 252 having lands, grooves and formation cutting elements as described above. The cutting face 252 is oriented in substantially flush or even relation with respect to the cutting face 254 of the outer drill bit. By angular positioning of the mud motor 230, the inner bit mandrel 248 and the inner drill bit 244 the cutting face 252 of the inner drill bit is located eccentrically with respect to the cutting face of the outer drill bit, thus establishing an orbiting rotational condition of the inner drill bit as the outer drill bit is rotated about its axis 242. The inner drill bit may be rotated clockwise or counter-clockwise by its hydraulic motor depending on the character of drilling activity that is being accomplished. This orbital orientation ensures that the central portion of the formation being drilled will be continuously cut away by the inner drill bit, thus relieving the outer drill bit to efficiently cut away a major portion of the formation material without any risk of becoming overheated and excessively worn by rapid penetration into the formation.

In FIGS. 20-22 a dual speed, dual torque drilling system is shown generally at 260 wherein a tubular stabilizer housing 262, which may also be referred to as a drill collar, is connected with a cross-over sub 264 that is in turn connected with a drill string for rotation by the rotary drive mechanism 2 of the drilling rig 1. A stabilizer member 266 is integral with or connected with the tubular stabilizer housing 262 and is oriented in substantially concentric relation with the stabilizer housing. A primary or outer drill bit, shown generally at 268, defines an outer drill bit body 270 that is connected with the stabilizer 266 by means of a threaded connection 272 or any other suitable mounting system.

The drill bit body 270 defines an inner bit chamber 274 of generally cylindrical configuration having a secondary or inner drill bit 276 positioned for rotation therein. The inner bit chamber 274 is eccentrically located relative to the center-line or axis of rotation 278 of the drill bit body 270 so that the downwardly facing opening 280 at the intersection of the inner bit chamber 274 with the cutting face 282 of the outer drill bit 268 will be rotated in orbital fashion about the axis of rotation 278 of the outer drill bit as the outer drill bit is rotated by the drill string. The inner drill bit 276 is mounted to an inner bit mandrel 284 which is supported for rotation within a tubular motor housing 286 of a hydraulic motor, shown generally at 288, by means of a bearing assembly. The stabilizer 266 defines a lower internal transverse support wall 290 having a housing mounting opening 292 within which the lower end portion of the tubular motor housing 286 is positioned for location and support.

The inner bit mandrel 284 and the inner drill bit 276 are rotatably driven about an axis 294 of inner drill bit rotation by the fluid energized hydraulic motor 288. The rotation axes 278 and 294 of the outer and inner drill bits are oriented in substantially parallel relation due to the laterally offset positioning of the hydraulic motor 288 and the inner drill bit 276 within the tubular housing 262. The lateral spacing between the rotation axes 278 and 294 determine the orbital excursion of the cutting face 296 of the inner drill bit as the outer drill bit 268 is rotated.

During this orbital movement the cutting face of the inner drill bit causes efficient cutting of the formation material at the central region of the borehole being drilled, thereby permitting the cutting face 282 of the outer drill bit to accomplish efficient cutting of a majority of the formation material. The rotation speed and torque of the outer drill bit is controlled by the rotational speed of the drill string while the rotational speed and torque of the inner drill bit is controlled by the volume and pressure of the drilling fluid that flows through the hydraulic motor. Typically the rotational speed of the inner drill bit is from 2 to 8 times faster than the rotational speed of the outer drill bit. Thus each of the dual drill bits is provided with the full torque that is generated by its individual rotary drive mechanism.

FIGS. 23-27 disclose a dual speed, dual torque drilling system shown generally at 300 wherein a primary or outer drill bit and a secondary or inner drill bit are each independently driven by downhole hydraulic motors. This embodiment facilitates drilling activity where a drill string is not rotated by a surface powered mechanism of a drilling rig but rather is moved linearly as borehole drilling is accomplished by a downhole motor operated drilling system. As shown in FIG. 23 a cross-over sub 302 is connected with the drill string 3 and serves to direct drilling fluid from the drill string into the upper fluid chamber 304 of a primary hydraulic motor shown generally at 306. The primary hydraulic motor incorporates a tubular motor housing 308 and includes a stator 310 and rotor 312 such as is described in connection with FIG. 2. A motor output shaft 314, driven by fluid energized rotation of the rotor member, is connected with a power transmission flex shaft 316 by a coupling 318. Pressurized drilling fluid from the annulus 320 flows into intersecting passages 321 of the power transmission flex shaft 316 and enters the flow passage 324 of an outer drill bit drive mandrel 326 that is connected in driven relation with the power transmission flex shaft 316. The outer drill bit drive mandrel 326 extends through a tubular bearing sub 328 and is supported for rotation by a bearing assembly shown generally at 330, which is of the same type that is shown and described in connection with FIG. 3.

The outer drill bit drive mandrel 326 defines an enlarged tubular portion 332 which is shown at the lower portion of FIG. 23 and at the upper portion of FIG. 24. As the primary hydraulic motor 306 is operated the tubular housing 342 is rotated at the speed and torque that is determined by the primary hydraulic motor. The enlarged tubular portion 332 of the outer drill bit drive mandrel 326 defines a support sub 334 that is secured by a box and pin connection 336 with a cross-over sub 338 that provides for motor support and conducts drilling fluid flow into a secondary hydraulic motor, shown generally at 340. The cross-over sub 338 is connected with a tubular secondary motor housing 342 by a threaded connection 344 so that the rotary motion of the primary bit mandrel 322 and the support sub 334, resulting from operation of the hydraulic motor 340, is transmitted to the tubular secondary motor housing 342. A stabilizer sub 346 is connected at the lower end of the tubular secondary motor housing 342 by a thread connection 348 and defines a stabilizer member 349.

As shown in FIGS. 24 and 25 a primary or outer drill bit 350 defines a drill bit body 352 that is connected with the lower portion of the stabilizer sub 346 by a threaded connection 354 and thus is rotated for drilling activity when the tubular housing 342 and the stabilizer sub are rotated by fluid energized operation of the primary hydraulic motor 306. The drill bit body 352 defines a bottom wall 356 having a central opening 358 within which a small core of formation material is received as the outer drill bit is rotated against the formation. To permit the flow of drilling fluid past this small core the central opening 358 includes a plurality of lateral relief areas 359 that extend laterally from the central portion of the opening 358 and define fluid flow passages past the central core. The bottom wall of the drill bit body 352 also defines a cutting face shown generally at 360 which is defined by a plurality of radiating curved lands 362 and grooves 364 of the shape, character and function as described above in connection with FIGS. 3 and 4. The curved lands 362 have leading edges 366 to which a multiplicity of formation cutting elements 368 are mounted in position and orientation for cutting away the formation material as the outer drill bit is rotated.

Within the stabilizer sub 346 is provided a bearing assembly shown generally at 370 which provides bearing support for a secondary drill bit mandrel 372 which is connected in driven relation with the power transmission flex shaft 374 and the motor output shaft 376 of the secondary hydraulic motor 340. The outer bit body 352 defines a generally cylindrical inner bit chamber 378 within which is located a secondary or inner drill bit 380 which is rotatably driven by the inner bit mandrel 372 in response to fluid energized operation of the secondary hydraulic motor 340. The inner drill bit defines a generally circular cutting face 382 having a plurality of radiating curved lands 384 and grooves 386. The radiating lands each define a leading edge 388 that may be of curved configuration as shown in FIGS. 26 and 27 and provide for support and orientation for a multiplicity of formation cutting elements 390 that may conveniently take the form of PDC cutting elements or may comprise any other suitable formation cutting elements or materials that are available within the state of the art.

The outer drill bit body 352 is located in eccentric relation with the axis that is defined by the tubular housing 342 and is thus rotated about a longitudinal axis 392. The inner bit chamber 378 defines a central longitudinal axis 394 that is laterally offset form the longitudinal axis 392, thus causing the inner drill bit 380 to have orbital rotation movement about the axis 392 as the outer drill bit is rotated by the primary hydraulic motor. The circular cutting face 382 of the inner drill bit is disposed in spaced relation with the internal surface of the wall 356 but is positioned so that a portion of the cutting face 382 overlies the central opening 358. Thus, as the inner drill bit is moved orbitally due to rotation of the outer drill bit the small core that is left by the outer drill bit is continuously cut away by the cutting elements of the inner drill bit. Since the radially outer portion of the cutting face of the inner drill bit achieves cutting of the formation core, the cutting elements of the inner drill bit have efficient cutting speed with respect to the formation material and thus inner bit formation cutting occurs at optimum efficiency and without any tendency to become overheated by the formation cutting activity. Moreover, formation cutting by the inner drill bit causes the outer drill bit to also achieve optimum efficiency since its cutting elements are not required to cut away the formation material at the central portion of the borehole. The primary and secondary hydraulic motors can be set to rotate at optimum speed and torque for optimum formation cutting capability.

The partial sectional views of FIGS. 28 and 29 and the bottom view of FIG. 30 illustrate the lower portion of a drilling system that is quite similar to the dual drill bit mechanism of FIGS. 23-27. The upper portion of the drilling system is preferably identical in construction and function as compared with the illustration of FIG. 23 and thus is not shown. Many of the drilling system components that are shown in FIGS. 28 and 29 are substantially identical with the drilling system components that are illustrated in the partial section views of FIGS. 23-25, thus like components are identified by like reference numerals. A primary or outer drill bit member 396 has a drill bit body 397 that is connected with the lower end of the stabilizer sub 346 by a threaded connection 398. A generally cylindrical inner bit chamber 400 is defined within the outer drill bit body 397 and has a downwardly facing opening 402 that is located at the cutting face 404 of the outer drill bit. A secondary or inner drill bit 406 is mounted for rotation within the inner bit chamber 400 by the inner drill bit mandrel 372 in response to secondary hydraulic motor operation and defines an inner bit cutting face 408 that is located in substantially flush or co-extensive relation with the cutting face 404 of the outer drill bit as shown in FIG. 29.

As shown in the lower portion of FIG. 29 and in FIG. 30 the cutting face 404 of the primary or outer drill bit 396 is defined by a plurality of spaced curved lands 410 and grooves 412 to provide for efficiency of formation cutting and to promote efficiency of drilling fluid flow across the cutting face. The lands 410 define curved leading edges 414 to which are fixed a plurality of formation cutting elements 416 such as PDC cutting elements. The body 397 of the primary drill bit is disposed in eccentric relation with the tubular housing 342 and has an axis of rotation 418. The secondary or inner drill bit 406 is driven by an inner bit mandrel 420 in response to operation of the secondary hydraulic motor 340 and has an axis of rotation 422 that is laterally offset from the axis of rotation of the primary drill bit, which causes orbital rotation of the inner drill bit about the axis 418 as it is simultaneously rotated about its axis 422. The central flow passage 421 of the inner bit drive mandrel is in communication with a plurality of branch passages 423 which provide for efficient distribution of drilling fluid flow to the cutting face of the inner drill bit and to the cutting face of the outer drill bit as well.

FIG. 31 illustrates a dual speed, dual torque drilling system quite similar to that of FIGS. 28-30, the difference being the recessed position of the inner drill bit as compared with the flush position shown in FIGS. 28 and 29. Components of the embodiment of FIG. 31 are indicated by like reference numerals as compared with drilling system of FIG. 29. A secondary or inner drill bit 424 is shown to be integral with the inner bit drive mandrel 420 and has a length such that its cutting face 408 is located at an intermediate position within the inner bit chamber 400 of the body 397 of the outer drill bit member 396. This feature is of the same construction and purpose as the drilling system that is shown in FIGS. 11-13, the difference being that the drill string is not intended to rotate during drilling and the outer drill bit is driven by a primary hydraulic motor such as is shown in FIG. 23 and the inner drill bit is driven by a secondary hydraulic motor such as is shown in FIG. 24. As drilling activity proceeds the cutting face of the outer drill bit will cut away a major portion of the formation material, leaving a quite small uncut central portion of the formation material that is significantly smaller than the diameter of the cutting face 408 of the inner drill bit. The dimension of this small uncut central region is determined by the circular cutting paths of the cutting elements of the cutting face of the outer drill bit which revolve about the axis of rotation 418. Since the cutting elements of the outer drill bit will not be required to remove the central portion of the formation material its cutting elements will have an optimum range of cutting speed with respect to the formation material and thus will operate with much less heat generation. As the outer drill bit proceeds through the formation the cutting face of the inner drill bit will efficiently cut away the small central portion of the formation material that remains. The inner drill bit will also be rotated at an optimum cutting speed with respect to the remaining formation material and thus will also achieve drilling with significantly less heat generation. The effective service life of the drilling system will be significantly enhanced by cooler running of the outer and inner drill bits.

FIG. 32 is a longitudinal sectional view of a dual speed, dual torque drilling system that incorporates many of the features of FIGS. 29 and 30, the difference being the concentric and co-axial relation of the inner drill bit with respect to the outer drill bit. The drilling system of FIG. 32 incorporates many of the features of the dual hydraulic motor drive system of FIGS. 23-25 and incorporates many of the features of the dual concentric drilling system of FIGS. 14-16. A stabilizer sub 426 is connected with the tubular housing 342 of the secondary hydraulic motor by a thread connection 428 and defines a stabilizer section 430 having spaced stabilizer blades that contact the wall of the borehole to maintain the stability and accuracy of drilling activity. The stabilizer section 430 is disposed in concentric relation with the tubular housing 342. Within the stabilizer sub 426 is located a bearing chamber having a bearing assembly 432 mounted therein and providing rotatable support for an inner bit drive mandrel 434 that has driving relation with an inner drill bit member 436. An outer drill bit member 438 is mounted to the stabilizer sub 426 by a threaded connection 440 and has a drill bit body 442 having a cutting face 444 and defining an inner drill bit chamber 446 within which the inner drill bit member 436 is rotatable by the inner bit drive mandrel 434 in response to operation of the secondary hydraulic motor. The inner drill bit member 436 is disposed in concentric relation with the stabilizer sub and with the outer drill bit member. The inner drill bit member defines a cutting face 443 having a multiplicity of cutting elements 447 that are mounted to the leading edges of spaced radial curved lands as described above. The cutting face 443 of the inner drill bit is recessed, i.e., located intermediate the axial length of the inner bit chamber 446 as shown in FIG. 32.

As borehole drilling progresses by rotation of the outer drill bit by its primary hydraulic motor the cutting elements 445 will cut away a major circular portion of the formation material, leaving a central portion of the formation material uncut. The cutting elements of the outer drill bit will be moved at an optimum range of cutting speed for formation cutting and for minimum heat generation during cutting. Simultaneously, the inner drill bit will be rotated by the inner bit drive mandrel 434 in response to operation of the secondary hydraulic motor of the drilling system. During drilling the cutting face of the inner drill bit will encounter and cut away the remaining central portion of the formation material. The inner drill bit will be rotated by its independent hydraulic motor as a speed of rotation that will move the formation cutting elements of the inner drill bit at a optimum cutting speed relative to the formation material for efficient cutting activity and minimal heat generation.

With reference to FIGS. 33-35 a dual speed, dual torque drilling system is shown generally at 450 is driven by dual hydraulic motors and is supported and positioned by a drill string that is not rotatable during drilling activity. The upper section of the drilling system is substantially identical with the primary hydraulic drive motor system that is shown in FIG. 23 and thus is not shown. The lower section of the drilling system incorporates many of the features that are shown in FIG. 24 and thus corresponding features are identified by like reference numerals. To the cross-over sub 338 is connected a tubular stabilizer housing 452 having a stabilizer member 454 formed integral therewith or connected in any suitable fashion. A primary or outer drill bit member 456 is connected with the stabilizer sub by a threaded connection 458 and defines an outer drill bit body 460 that is disposed in concentric relation with the stabilizer sub and thus is rotatable about an axis of rotation 462 as the primary hydraulic motor is operated by fluid flow therethrough. The outer drill bit member 456 defines an inner drill bit chamber 464 of generally cylindrical configuration and having an inclined orientation within the outer drill bit body as is evident in FIGS. 33 and 34.

Within the tubular stabilizer housing 452 is mounted a support partition 466 having a motor positioning opening 468 within which is positioned the upper end portion of a secondary hydraulic motor shown generally at 470. A similar support partition 465 within the lower end of the stabilizer sub defines a support opening 467 within which is received the lower end portion of the hydraulic motor 470. The secondary hydraulic motor incorporates a cross-over sub 472 at its upper end for channeling a portion of the drilling fluid flow into the upper fluid chamber 474 of the secondary hydraulic motor and has an internal lobed stator 476 and lobed rotor 478 which responds to fluid flow to develop rotary motion of the rotor. The secondary hydraulic motor 470 has an elongate tubular motor housing 480 which contains a bearing assembly, not shown, for rotational support of an inner drill bit drive mandrel 482. A secondary or inner drill bit 484 is integral with or connected with the inner drill bit drive mandrel serves to impart rotary motion to the inner drill bit in response to fluid energized operation of the secondary hydraulic motor 470. The inner drill bit chamber 464 is protected by wear resistant sleeves 486 and 488 and an exterior wear resistant sleeve or hardfacing 490 is employed for minimizing wear of the inner drill bit during drilling activity.

The outer drill bit has an axis of rotation 492 which is concentric with the tubular housing 452 and the stabilizer sub. Due to the angulated position of the secondary hydraulic motor within the housing 452 the secondary drill bit 484 is rotatable about an axis 494 that is disposed in angular relation with the axis of rotation 492. This arrangement positions the cutting face 496 of the inner drill bit in laterally offset relation with the axis of rotation 492 of the outer drill bit. The inner drill bit chamber 464 intersects the cutting face 497 of the outer drill bit at a position that is off center with respect to the axis of rotation 492. By virtue of its off center positioning as the outer drill bit is rotated by the primary hydraulic motor the inner drill bit will be rotated orbitally about the axis 492. Simultaneously the inner drill bit will be rotated about its axis 494 either clockwise or counter-clockwise depending on the design of the drilling system. The cutting elements 498 of the outer drill bit will cut away a majority of the formation material to form the borehole, leaving a small central portion of the formation material. The cutting elements 495 of the inner drill bit are position essentially co-extensive or substantially flush with the cutting elements 497 of the outer drill bit and accomplish continual cutting of the remaining formation material at the central region of the borehole. This feature permits the outer drill bit to be rotated at an optimum speed for efficient cutting of the formation material without necessitating the generation of excessive heat and permits the inner drill bit to be rotated at its optimum speed for efficient cutting of the formation material and for minimizing heat generation.

Referring to FIGS. 35-37, a dual speed, dual torque drilling system, shown generally at 500 is driven by dual hydraulic motors and incorporates an upper section which may be substantially identical in construction and function as compared with the primary hydraulic drilling motor and bearing assembly that is shown in FIG. 23. As mentioned above, the drilling system 500 is intended to be mounted to a drill string that is moved linearly but is not rotated during drilling activity. A tubular primary bit mandrel 322, which has rotary motion due to its driven relation with the primary hydraulic motor of the upper section of the drilling system, defines a mandrel connector 502 that is mounted to a cross-over sub 504 by a box and pin connection 506. A tubular housing 508 is connected with the cross-over sub 504 by a thread connection 510 and includes a lower portion defining a concentric stabilizer 512. A primary or outer drill bit 514 is connected with the stabilizer by a threaded connection 516 and has a drill bit body 518 defining a cutting face 520. The drill bit body 518 defines a generally cylindrical inner drill bit chamber 522 within which a secondary or inner drill bit 524 is supported for rotation by an inner drill bit mandrel 526.

Within the upper portion of the tubular housing 508 a transverse support partition 528 is fixed and defines a support opening 530 within which the upper cross-over sub 532 of a secondary hydraulic motor shown generally at 534 is secured. The secondary hydraulic motor 534 is located along an inner surface 536 of the tubular housing 508 and thus defines a center-line or axis of rotation 538 that is disposed in parallel relation with a center-line or axis of rotation 540 of the tubular housing 508, the stabilizer 512 and the primary or outer drill bit 514. An internal support partition 542 is located within the lower portion of the stabilizer 512 and defines a support opening 544 within which a lower portion of the tubular housing 546 of the secondary hydraulic motor is secured. Within the tubular housing 546 is provided a tubular internally lobed stator member 548 and an elongate lobed rotor member 550. Drilling fluid which enters the secondary hydraulic motor from the fluid passage 552 flows through the secondary hydraulic motor and imparts rotation to the rotor member 550. The rotor member has an output shaft that is coupled in driving relation with the inner drill bit drive mandrel 526 thus providing for rotation of the inner drill bit within the inner drill bit chamber with the rotational speed and torque that is determined by the flow of drilling fluid.

The inner drill bit drive mandrel 526 defines a central fluid flow passage 554 that conducts the flow of drilling fluid through the mandrel and through the inner drill bit. A plurality of angulated branch passages 556 within the inner drill bit intersect the central fluid flow passage 554 and provide for even distribution of the flowing drilling fluid to the cutting faces of both the inner drill bit and the outer drill bit. As is evident in FIG. 36 the cutting face 520 of the outer drill bit is provided with a multiplicity of formation cutting elements 558 which engage and cut away the formation material as the outer drill bit 514 is rotated by the primary hydraulic motor. As shown in FIG. 37 the cutting face 520 of the outer drill bit is defined by a plurality of radiating curved lands 560 that are disposed in spaced relation and define grooves or channels between the lands to provide for distribution of drilling fluid throughout the cutting face. The lands define curved leading edges 562 to which the cutting elements 558 are fixed and positioned for efficient cutting activity. The inner drill bit has a cutting face defining radiating curved lands 564 having formation cutting elements 566 mounted to the curved leading edges 568 thereof.

Rotation of the outer drill bit will cause the cutting elements 558 to cut away a major portion of the formation material of the borehole, leaving a small central region uncut. Due to the laterally offset position of the inner drill bit chamber 522, upon rotation of the outer drill bit 514 the inner drill bit will be caused to rotate orbitally, with the axis of rotation 540 of the orbit being the center of rotation 540 of the outer drill bit. This feature permits the cutting elements of the outer drill bit to have an optimum range of cutting speed relative to the formation material for efficiency of cutting activity, without generation of excessive heat. The cutting elements of the smaller diameter inner drill bit will also be caused to have movement at an optimum range of cutting speed relative to the formation material with minimal heat generation. The rate of penetration of this drilling system into the formation material is exceptional and the resulting service life of the drilling system will be significantly extended in comparison with conventional drill bits.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A method for drilling boreholes in earth formations, comprising:

rotating an outer drill bit with a primary power source about a primary axis of rotation and against an earth formation, the outer drill bit having an outer bit cutting face in cutting engagement with the earth formation and defining an inner bit chamber intersecting said outer bit cutting face and defining an inner bit chamber opening at said outer bit cutting face;

with a secondary power source independently rotating an inner drill bit having an inner bit cutting face within said inner bit chamber with said inner bit cutting face located within said inner bit chamber opening and having formation cutting engagement with the formation simultaneously with said rotating said outer drill bit in cutting engagement with the formation;

said rotating said inner drill bit being rotating said inner drill bit within said inner bit chamber about an axis of rotation that is laterally offset from said primary axis of rotation and developing an orbital pattern of formation cutting motion of said inner drill bit in cutting engagement with the formation about said primary axis of rotation responsive to rotation of said outer drill bit; and rotating said inner drill bit with said secondary power source independently of rotation of said outer drill bit and simultaneously with rotation of said outer drill bit with said primary power source.

2. The method of claim 1, comprising:

applying the horsepower and torque of a rotary drill string as said primary power source to said outer drill bit; and applying the horsepower and torque of a hydraulically energized rotary motor as said secondary power source to said inner drill bit.

3. The method of claim 1, comprising:

rotating said outer drill bit at a primary bit rotary speed; and rotating said inner drill bit at a rotary speed that is variable in comparison with said primary bit rotary speed.

4. The method of claim 1, comprising:

rotating said outer drill bit in a selected direction of rotation; and rotating said inner drill bit in a direction of rotation that is the same as said selected direction of rotation.

5. The method of claim 1 wherein an inner bit cutting face is provided on said inner drill bit, said method comprising:

with said inner drill bit having said inner bit cutting face positioned in recessed relation within said inner drill bit chamber and inwardly of said outer bit cutting face conducting drilling by simultaneous rotation of said outer drill bit and said inner drill bit within said inner drill bit chamber of said outer drill bit.

6. The method of claim 1, comprising:

positioning said inner drill bit with said inner bit cutting face being positioned within said inner bit passage with said inner bit cutting face being located in coextensive relation with said outer bit cutting face.

7. A drilling unit for drilling a borehole in a formation material, comprising:

a primary rotary drive system;

an outer drill bit being rotationally driven by a said primary rotary drive system about a primary axis of rotation and having an outer bit cutting face disposed for drilling engagement with the formation material, said outer drill bit defining an inner bit chamber having a chamber opening at said outer bit cutting face, said inner bit chamber being of substantially cylindrical configuration and having eccentric relation with said primary axis of rotation;

a secondary rotary drive system;

an inner drill bit being rotationally driven within said inner bit chamber by a said secondary rotary drive system and having a secondary axis of rotation being laterally offset from said primary axis of rotation and having substantially concentric relation with said inner bit chamber, said inner drill bit having an inner bit cutting face located within said inner bit chamber and being disposed for cutting engagement with the formation material within said chamber opening; and said outer and inner drill bits being simultaneously and independently rotated for drilling within the formation.

8. The drilling unit of claim 7, comprising:

said primary rotary drive system being a drill string being rotationally driven by a power energized rotary drive mechanism of a drilling rig; and said secondary rotary drive system being a hydraulic fluid energized drive mechanism causing fluid flow through said drill string by a fluid pump system of the drilling rig and providing fluid energized rotation of said inner drill bit.

9. The drilling unit of claim 7, comprising:

said inner bit chamber being of a dimension and location causing orbital sweeping of said inner bit cutting face across a central region of the wellbore being drilled such that said cutting face of said inner drill bit cuts away all formation material of said central region of the wellbore that is not cut away by said outer drill bit and permits cutting of an outer circular region of formation material by said outer drill bit.

10. The drilling unit of claim 7, comprising:

said primary rotary drive mechanism rotating said outer drill bit in a selected direction of rotation; and said secondary rotary drive mechanism rotating said inner drill bit in a direction of rotation that is opposite said selected direction of rotation.

11. The drilling unit of claim 7, comprising:

said primary rotary drive mechanism rotating said outer drill bit in a selected direction of rotation; and said secondary rotary drive mechanism rotating said inner drill bit in a direction of rotation that is the same as said selected direction of rotation.

12. The drilling unit of claim 7, comprising:

said inner bit cutting face being located within said inner bit chamber and in recessed relation with said outer bit cutting face.

13. The drilling unit of claim 7, comprising:

a substantially circular array of formation cutting elements being located on said outer drill bit and cutting away a substantially circular region of the formation material during rotary drilling;

said outer drill bit defining a wall separating said inner bit chamber from said formation and defining a chamber opening through which a central portion of the formation material progresses into said inner bit chamber during drilling; and said inner bit cutting face being located within said inner bit chamber and in recessed relation with said outer bit cutting face and being oriented for continuously cutting away the central portion of the formation material that is not cut away by said substantially circular array of formation cutting elements of said outer drill bit and progresses into said inner bit chamber.

14. The drilling unit of claim 7, comprising:

said outer drill bit having an outer bit cutting face and said inner drill bit having an inner bit cutting face;

cutter elements being located on said outer drill bit cutting face being located on said inner bit cutting face and being positioned in cutting relation with the formation material during drilling;

said outer drill bit having a desired range of rotation for efficient formation cutting by said cutter elements thereof; and said inner drill bit being driven as a sufficiently rapid rotary speed relative to the rotary speed of said outer drill bit that said cutter elements of said inner drill bit cutting face are moved relative to the formation at substantially the same range of cutting speed as said cutter elements of said outer bit cutting face.

15. The drilling unit of claim 7, comprising:

a plurality of PDC cutter elements being fixed to said outer bit cutting face;

a plurality of PDC cutter elements being fixed to said inner bit cutting face; and said inner drill bit being driven as a sufficiently rapid rotary speed relative to said outer drill bit that said PDC cutter elements of said inner bit cutting face are moved relative to the formation at substantially the same range of cutting speed as said PDC cutter elements of said outer bit cutting face.

16. The drilling unit of claim 7, comprising:

a primary rotary drive member defining a central axis of rotation;

said outer drill bit being rotatably driven by said primary rotary drive system and being disposed in concentric relation with said central axis of rotation;

an inner bit drive member extending from said secondary rotary drive system and extending through at least a part of said outer drill bit; and said inner drill bit having driven connection with said inner bit drive member and being rotated by said secondary rotary drive system simultaneously with orbital rotation of said inner drill bit by within said outer drill bit.

17. A drilling unit for drilling a borehole in a formation material, comprising:

a tubular drill string being rotationally driven by a rotary drive mechanism of a drilling system and defining a fluid flow passage;

a hydraulic fluid supply system of the drilling unit having a fluid pump communicating pump energized pressurized drilling fluid to said fluid flow passage;

an outer drill bit being mounted to said drill string and being rotationally driven thereby about a primary longitudinal axis of rotation and having an outer bit cutting face disposed for cutting away an outer annular region of the formation material during rotary drilling engagement with the formation material, said outer drill bit defining an inner bit chamber having a chamber opening intersecting said outer bit cutting face and being laterally offset from said primary longitudinal axis of rotation;

an inner drill bit being rotationally driven within said inner bit chamber by a hydraulic fluid energized secondary rotary drive mechanism and having a secondary axis of rotation being laterally offset from said primary axis of rotation;

said inner drill bit having an inner bit cutting face located within said chamber opening of said outer drill bit and having a sufficient dimension for cutting away the formation material that is not cut away by said cutting face of said outer drill bit; and rotation of said outer drill bit for borehole drilling causing orbital rotation of said inner drill bit about said primary axis of rotation simultaneously with rotation of said inner drill bit about said secondary axis of rotation and causing sweeping of said inner bit cutting face across and cutting away a central region of the formation material of the borehole being drilled while the majority of the formation material of the borehole is cut away by the cutting face of said primary drill bit.

18. The drilling unit of claim 17, comprising:

said primary rotary drive mechanism rotating said outer drill bit in a selected direction of rotation; and rotating said inner drill bit in a direction of rotation that is the same as said selected direction of rotation.

19. The drilling unit of claim 17, comprising:

said inner bit cutting face being located within said inner bit chamber opening and being disposed within said inner bit chamber and in recessed relation with said outer bit cutting face.

20. The drilling unit of claim 17, comprising:

said inner drill bit being driven as a sufficiently rapid rotary speed relative to said outer drill bit that said PDC cutter elements of said inner bit cutting face are moved relative to the formation at substantially the same range of cutting speed as said PDC cutter elements of said outer bit cutting face.

21. The drilling unit of claim 17, comprising:

a plurality of PDC cutter elements being fixed to said outer bit cutting face;

a plurality of PDC cutter elements being fixed to said inner bit cutting face; and said inner drill bit being driven as a sufficiently rapid rotary speed relative to said outer drill bit that said PDC cutter elements of said inner bit cutting face are moved relative to the formation at substantially the same cutting speed as said PDC cutter elements of said outer bit cutting face.

22. The drilling unit of claim 17, comprising:

a primary rotary drive member defining a central axis of rotation;

said outer drill bit having an outer drill bit axis of rotation being in concentric relation with said central axis of rotation;

an inner bit drive member extending from said secondary rotary drive member and extending through at least a part of said outer drill bit; and said inner drill bit having driven connection with said inner bit drive member and being rotated by said secondary rotary drive member simultaneously with orbital rotation of said inner drill bit by said outer drill bit.

* * * * *